US008893640B2

(12) United States Patent
Stephinson et al.

(10) Patent No.: US 8,893,640 B2
(45) Date of Patent: Nov. 25, 2014

(54) HYDROFOIL

(71) Applicant: Concepts IP Pty Ltd, St. Ives (AU)

(72) Inventors: William Peter Stephinson, New South Wales (AU); Ian Alan Ward, St. Ives (AU)

(73) Assignee: Concepts IP Pty Ltd, North Sydney, NSW (AU)

( * ) Notice: Subject to any disclaimer, the term of this patent is extended or adjusted under 35 U.S.C. 154(b) by 84 days.

(21) Appl. No.: 13/772,032

(22) Filed: Feb. 20, 2013

(65) Prior Publication Data

US 2013/0228111 A1 Sep. 5, 2013

Related U.S. Application Data

(63) Continuation of application No. PCT/AU2011/001069, filed on Aug. 19, 2011.

(30) Foreign Application Priority Data

Aug. 20, 2010 (AU) ..... 2010903746

(51) Int. Cl.
*B63B 1/28* (2006.01)

(52) U.S. Cl.
CPC ..... *B63B 1/285* (2013.01)
USPC ..... 114/275; 114/39.24

(58) Field of Classification Search
USPC ..... 114/271, 274, 275, 277, 278, 280, 282, 114/39.21, 39.24
See application file for complete search history.

(56) References Cited

U.S. PATENT DOCUMENTS

| | | | | |
|---|---|---|---|---|
| 3,812,806 | A * | 5/1974 | Korotkov et al. | 114/275 |
| 3,902,444 | A * | 9/1975 | Stark | 114/275 |
| 3,910,215 | A | 10/1975 | Soderman | |
| 4,010,705 | A | 3/1977 | Connell et al. | |
| 4,208,980 | A * | 6/1980 | Henkel | 114/274 |
| 4,561,371 | A | 12/1985 | Kelley et al. | |
| 5,054,410 | A | 10/1991 | Scarborough | |
| 5,448,963 | A | 9/1995 | Gallington | |
| 6,499,419 | B1 | 12/2002 | Bussard | |

FOREIGN PATENT DOCUMENTS

| | | |
|---|---|---|
| DE | 20200811172 | 3/2009 |
| GB | 516651 | 1/1940 |
| GB | 643682 | 9/1950 |
| GB | 713943 | 8/1954 |
| JP | 62-289495 | 12/1987 |

OTHER PUBLICATIONS

International Preliminary Report on Patentability issued in corresponding International Application No. PCT/AU2011/001069, completed on Dec. 14, 2012.

* cited by examiner

*Primary Examiner* — Lars A Olson
(74) *Attorney, Agent, or Firm* — Fish & Richardson P.C.

(57) ABSTRACT

A hydrofoil assembly for a waterborne vessel, comprising: a body; a hydrofoil mounted to the body, the hydrofoil being adjustable to vary its lift characteristics; and a control mechanism operative to control the adjustment of the hydrofoil assembly relative to the support.

20 Claims, 27 Drawing Sheets

HYDROFOIL

CROSS-REFERENCE TO RELATED APPLICATIONS

This application is a continuation and claims priority under 35 U.S.C. §120 to PCT Application No. PCT/AU2011/001069, filed on Aug. 19, 2011, which claims priority to Australian Application No. 2010903746, filed on Aug. 20, 2010. The contents of both of these priority applications are hereby incorporated by reference in their entireties.

TECHNICAL FIELD

The present invention generally relates to hydrofoils used with water-borne vessels. The invention has particular application, to sailing vessels and will herein be described in that context.

BACKGROUND

Water vessels fitted with hydrofoils offer improved performance for vessels at speed. A hydrofoil is generally a wing or wing like structure mounted on struts beneath the vessels which act to lift the vessel from the water during forward motion. As the hull of the vessel is lifted from the water, the drag of the vessel in the water is reduced, thereby increasing potential speed.

SUMMARY

In a first aspect, there is provided a hydrofoil assembly for a waterborne vessel, comprising; a support mountable to the vessel; a body movably mounted to the support and movable relative to the support between a first and second position; and a hydrofoil mounted to the body by a coupling, the hydrofoil being able to articulate about the coupling to provide a variable-incidence hydrofoil.

In one form of the hydrofoil assembly, the body is movable between the first and second positions at least in part by sliding of the body relative to the support.

In one form, the body is movable between the first and second positions at least in part by rotating of the body relative to the support.

In one form, the coupling has a pivot axis about which the hydrofoil articulates relative to the body. In a further form, the pivot axis extends through or proximal the centre of pressure of the hydrofoil.

In one form, the variable-incidence hydrofoil provides a variable lift hydrofoil.

In another aspect, there is provided a hydrofoil assembly for a waterborne vessel comprising: a support mountable to the vessel, the support having a first end which in use faces towards the bow of the vessel and a second end which in use faces towards the stern of the vessel; a body movably mounted to the support and movable relative to the support between a locked and an unlocked condition; the body having a forward facing surface and an opposite rearward facing surface and a hydrofoil assembly attached to the body, wherein the body is arranged to be movable from the locked to the unlocked condition by an impact above a threshold loading applied to the forward facing surface of the body causing rearward displacement of a distal end of the body.

In another aspect, there is provided a hydrofoil assembly for a waterborne vessel comprising: a support mountable to the vessel, the support having a first end which in use faces towards the bow of the vessel and a second end which in use faces towards the stern of the vessel; a body rotatably mounted to the support and movable relative to the support between a locked and an unlocked condition; and a hydrofoil assembly attached to the body, wherein the body is arranged to be movable from the locked to the unlocked condition by rotation of the body in the support towards the first end of the support.

In another aspect, there is provided a hydrofoil assembly for a waterborne vessel comprising: a support mountable to the vessel, the support having a first end which in use faces towards the bow of the vessel and a second end which in use faces towards the stern of the vessel; a body rotatably mounted to the support and movable relative to the support between a locked and an unlocked condition; and a hydrofoil assembly attached to the body, wherein the body is arranged to be movable from the locked to the unlocked condition by displacement of a distal end of the body toward the second end of the support.

In one form of the hydrofoil assembly, the body is movable relative to the support from an extended position to a retracted position when in the unlocked condition.

In one form, the body is slidable relative to the support between the extended and retracted positions.

In one aspect, there is provided a hydrofoil assembly for a waterborne vessel, comprising: a body; a hydrofoil mounted to the body, the hydrofoil being adjustable to vary its lift characteristics; and a control mechanism operative to control the adjustment of the hydrofoil assembly relative to the support.

In one form, at least part of the control mechanism is mounted to the body.

In a particular form, at least part of the control mechanism is mounted within the body.

In one form of the hydrofoil assembly, the control mechanism comprises a sensor responsive to the altitude of the vessel relative to the water, a controller to provide a control output based on responses of the sensor, and an actuator to vary lift in the hydrofoil based on the control output of the controller.

In one form, the sensor comprises a displaceable wand pivotally mounted to the body. In a further form, the wand is located at an intermediate region of the body. In another form, the sensor is located on other parts of the vessel.

In a particular form, the hydrofoil assembly further comprises a support mountable to the vessel, and wherein the body is mounted to the support. In one form, at least part of the control mechanism is mounted to the support. In one form, where the sensor comprises a displaceable wand, that wand is mounted to the support.

In one form of the hydrofoil assembly, the controller provides a control output that is non-linear to the sensor responses. In a further form, the controller providing the non-linear control output is a mechanical cam connected to the actuator.

In one form of the hydrofoil assembly, the hydrofoil is mounted to the body by a coupling, the hydrofoil being able to articulate about the coupling to provide a variable-incidence hydrofoil, and wherein the actuator is a pushrod connected to the hydrofoil to articulate the hydrofoil about the coupling.

In an alternative embodiment, the hydrofoil assembly has a fixed incidence hydrofoil, with a variable incidence flap. In this embodiment, the flap is actuated by a pushrod connected to the flap, whereby actuation of the pushrod varies the incidence of the flap, and thus altering the lift of the hydrofoil assembly.

In another aspect, there is provided a hydrofoil assembly for a waterborne vessel, comprising: a body; a hydrofoil pivotally attached to the body, wherein during forward motion of the vessel, water flowing across the hydrofoil biases the hydrofoil to pivot to a neutral position in which no lift is generated; and an actuator arranged to apply a biasing force to the hydrofoil to change the incidence of the hydrofoil relative to body to create lift, wherein the actuator provides a biasing force in only one direction and in the absence of biasing force by the actuator, the hydrofoil is biased in use to return to the neutral position by water flowing across the hydrofoil.

In another aspect, there is provided a hydrofoil assembly for a waterborne vessel, comprising: a body; a hydrofoil attached to the body, wherein in use, the hydrofoil assembly forms part of the centreboard of the vessel.

In one form of the hydrofoil assembly, the assembly is mounted to a centreboard insert.

In another form of the hydrofoil assembly, the assembly is a retrofit assembly to replace at least part of a centreboard assembly of the vessel.

In another aspect, there is provided a hydrofoil assembly for a waterborne vessel, comprising: a body and a hydrofoil attached to the body, wherein in use the hydrofoil assembly forms at least part of a rudder of the vessel.

In one form, the hydrofoil assembly is mounted to a rudder box of the vessel.

In another form, the hydrofoil assembly is a retrofit assembly to replace at least part of the rudder of the vessel.

In one form of the hydrofoil assembly the hydrofoil has a symmetrical foil section. Advantageously, this allows the water to naturally bias the foil section to a neutral orientation. However, it can be appreciated that in other forms, the hydrofoil may have an asymmetric foil section. In a further form, the body is a foil and the body and hydrofoil have identical foil sections. In other forms, the body and hydrofoil may be of different section shape or size.

In another aspect, there is provided a support for a hydrofoil assembly, wherein the support comprises; an aperture for slidingly receiving a portion of a hydrofoil assembly; and a surface for supporting the hydrofoil assembly.

In one form, the support further comprises a lock mechanism for releaseably locking the hydrofoil assembly to the support.

In one form, the support further comprises at least one channel for receiving a sensor wand in the hydrofoil assembly.

In another aspect, there is provided a waterborne vessel comprising: a hull; and at least one hydrofoil assembly according to any form described above. In one further form, the vessel is a sailing vessel.

In one form, a plurality of the hydrofoil assemblies are located along the centreline of the vessel. Advantageously, hydrofoil assemblies along the centreline allow effective heeling of the vessel on either side. However, it is to be appreciated that other hydrofoil configurations may be used, such as tri-foil configurations.

BRIEF DESCRIPTION OF THE DRAWINGS

It is convenient to hereinafter describe embodiments of hydrofoil assemblies with reference to the accompanying drawings. The particularity of the drawings and related description is to be understood as not superceding the preceding broad disclosure.

In the drawings.

DETAILED DESCRIPTION

Figure 1:
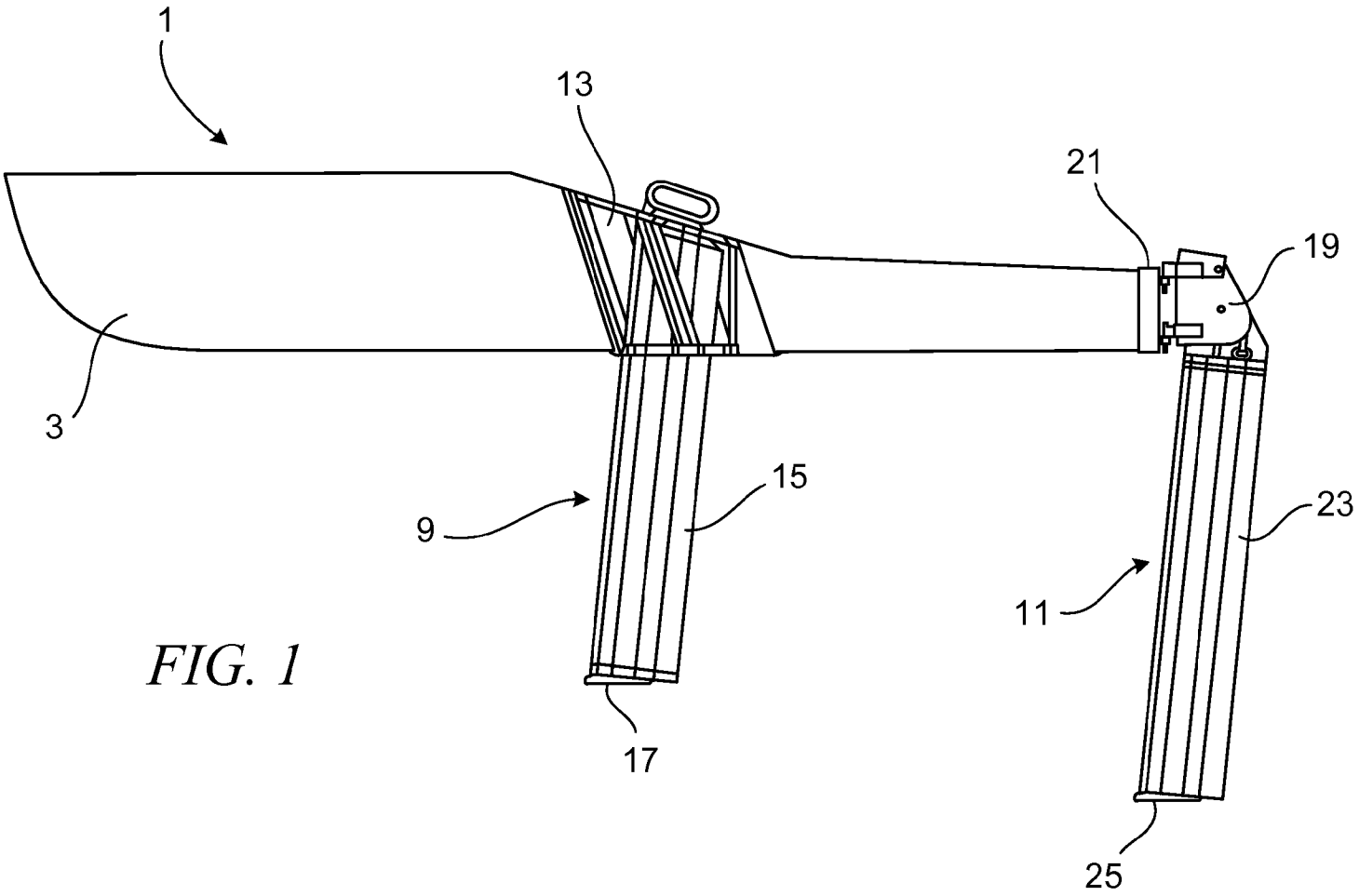
FIG. 1 is a side view of a vessel with hydrofoil assemblies in the extended configuration.

FIG. 1 illustrates a vessel 1 having a hull 3. Along the centreline of the hull 3, there are two retractable hydrofoil assemblies 9, 11 in the extended configuration. The first main hydrofoil assembly 9 is located midship along the hull. The second rudder hydrofoil assembly 11 is located towards the stern.

The main hydrofoil assembly 9, comprises of a centre case support 13 to which a body in the form of a vertical foil 15 is slidingly attached. At the lower end of the vertical foil 15, there is provided a main hydrofoil 17 that is pivotally attached to the vertical foil 15.

The rudder hydrofoil assembly 11, comprises of a rudder support 19 mounted to a rudder box 21 of the vessel. A body in the form of a rudder foil 23 is pivotally attached to the rudder support 19, and a rudder hydrofoil 25 is pivotally attached to the rudder foil 23.

As illustrated in FIG. 1, the vertical foil 15 and rudder foil 19 is locked in an extended configuration below the hull of the vessel 1. This prevents sliding movement of the vertical support foil 15 relative to the centre case support 13, and pivotal movement of the rudder foil 23 relative to the rudder support 19. In this extended configuration, there is a vertical clearance between the baseline of the hull 1, and the hydrofoils 17 and 25.

In forward motion of the vessel 1, lift is generated by the hydrofoils 17 and 25 due to their angle of attack to the water flow, which in turn lifts the hull 3 of the vessel 1 above the surface of the water.

Figure 2:
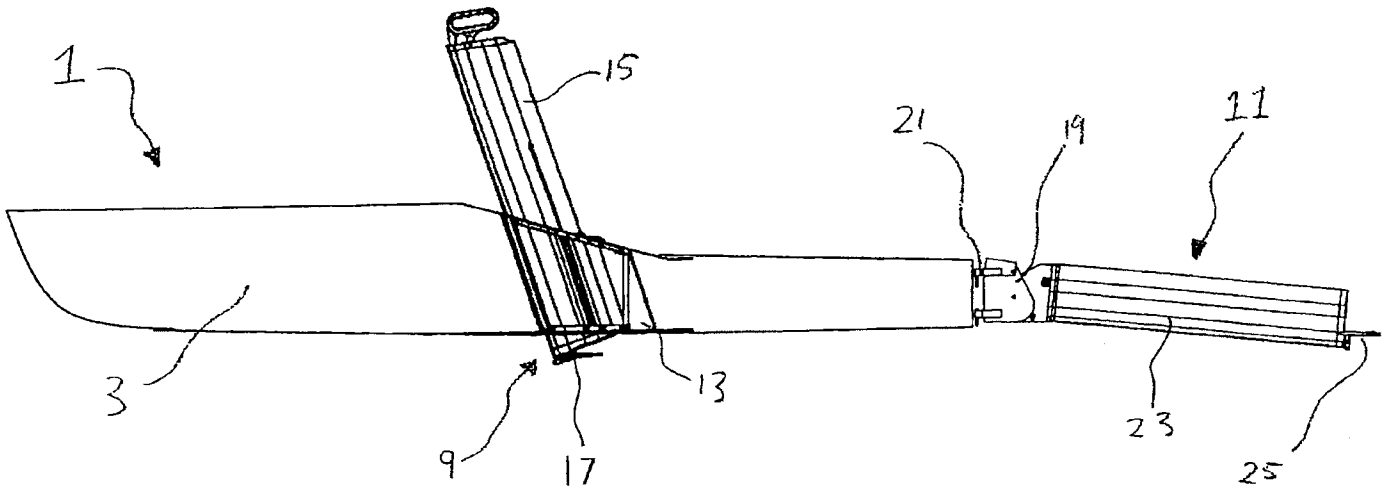
FIG. 2 is a side view of the vessel in FIG. 1 with the hydrofoil assemblies in the retracted configuration.
Figure 4:
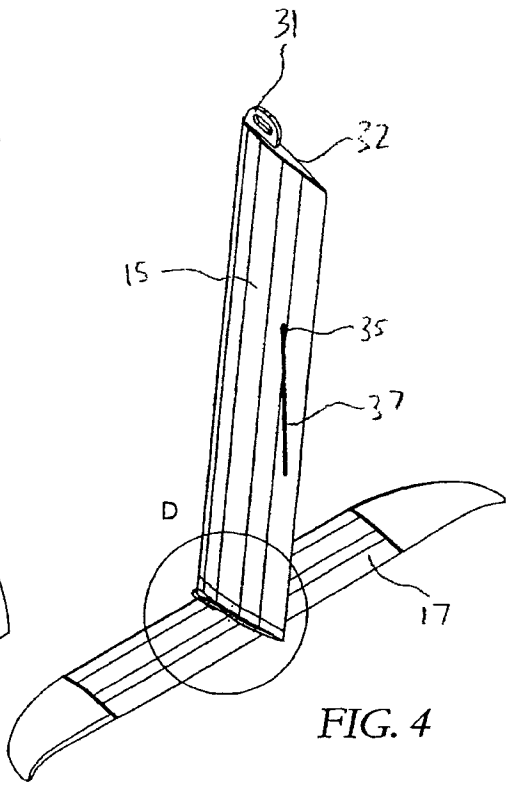
FIG. 4 is an alternative isometric view of the assembly in FIG. 3.
Figure 5:
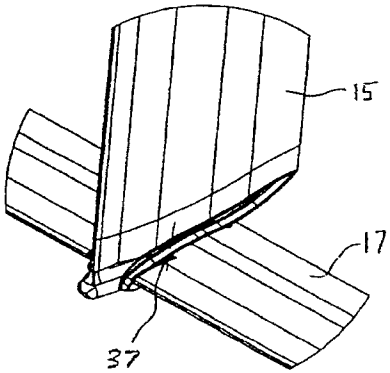
FIG. 5 is a close up view of area C in FIG. 3.
Figure 6:
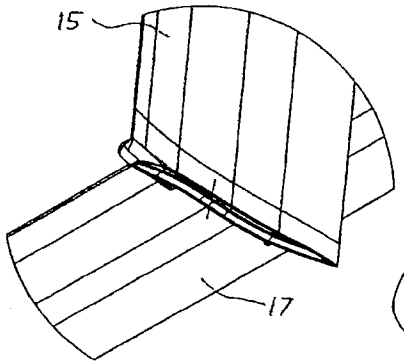
FIG. 6 is a close up view of area D in FIG. 4.
Figure 3:
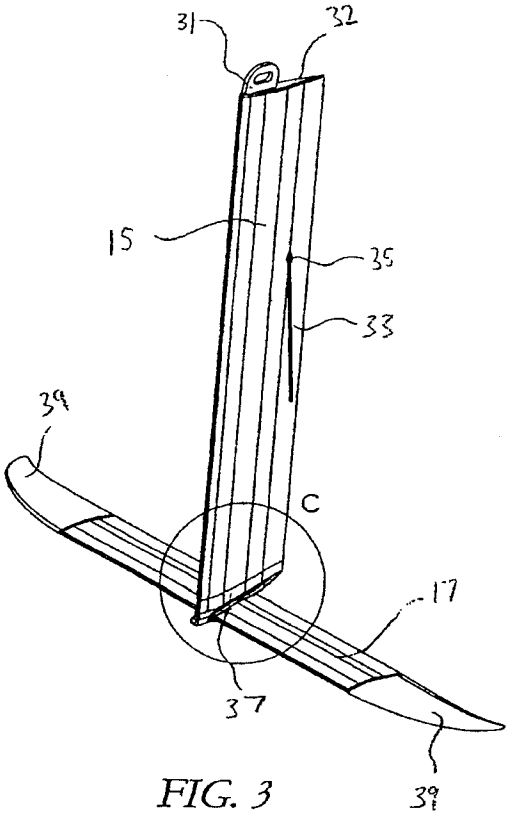
FIG. 3 is an isometric view of the main hydrofoil assembly.

FIG. 2 illustrates the vessel 1, with the hydrofoil assemblies 9, 11 in the retracted configuration. The vertical foil 15 of the main hydrofoil assembly 9 is slidingly retracted and locked into the hull 3 of the vessel 1. The rudder foil 23, is pivotally swung and locked in a trailing orientation.

As clearly shown in FIG. 2, the components of the hydrofoil assemblies 9 and 11 in the retracted position are much closer to the baseline of the hull 3, thereby reducing the draft of the vessel 1. This is advantageous when launching and retrieving the vessel in shallow waters.

Figure 48:
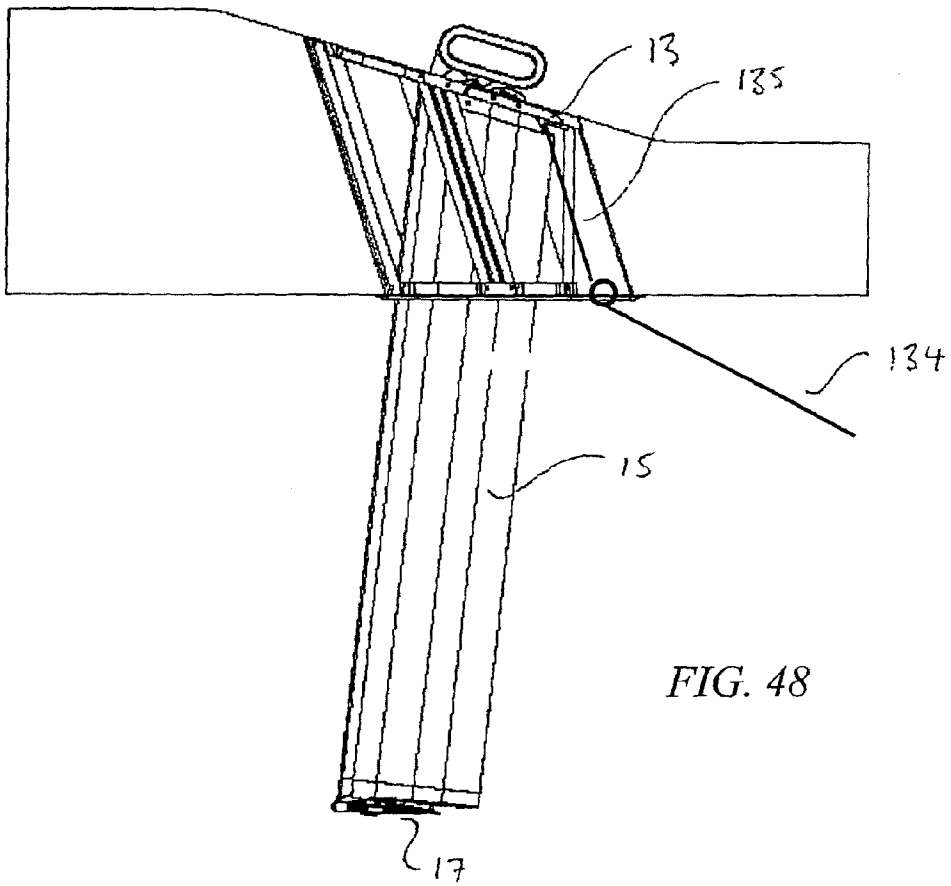
FIG. 48 is an alternative embodiment of a main hydrofoil assembly in the extended configuration.

The structure of the main hydrofoil assembly 9 will now be described with reference to FIGS. 3 to 12. The vertical foil 15 has a handle 31 at the upper end for the user to manipulate the main hydrofoil assembly 9 from the extended and retracted configurations. Rearward of the handle 31 is a support surface 32 to abut with the support 13 in the extended configuration. A sensor wand 33 is pivotally mounted at pivot 35, at an intermediate region of the vertical foil 15. In this particular embodiment, a sensor wand is located on both sides of the vertical foil 15. The sensor wands form part of a control mechanism (which also includes pushrod 41, cam 59 and pivot 35 as described in more detail below) to control the pivoting of the hydrofoil 17. Advantageously, having a sensor wand on both sides of the vertical foil 15, allows the sensor wands to operate effectively when the vessel 1 is heeled on either side Therefore, the response of the control mechanism is the same on both tacks. In an alternative form, one or more of the sensor wands are mounted on other parts of the vessel. In the form as shown in FIG. 48, a sensor wand 134 is mounted to the trailing end of the support 13. The sensor wand is connected to other components of the control mechanism by any suitable connection, such as through linkage assembly 135 as shown schematically in FIG. 43.

At the lower end of the vertical foil 15, the main hydrofoil 17 articulates about a coupling 37, so that the incidence (i.e. the angle of attack) of the main hydrofoil 17 can be varied to adjust the lift provided by the hydrofoil 17. The foil section of the main hydrofoil is symmetrical and the ends of the main hydrofoil 17 are provided with wings 39.

Figure 8:
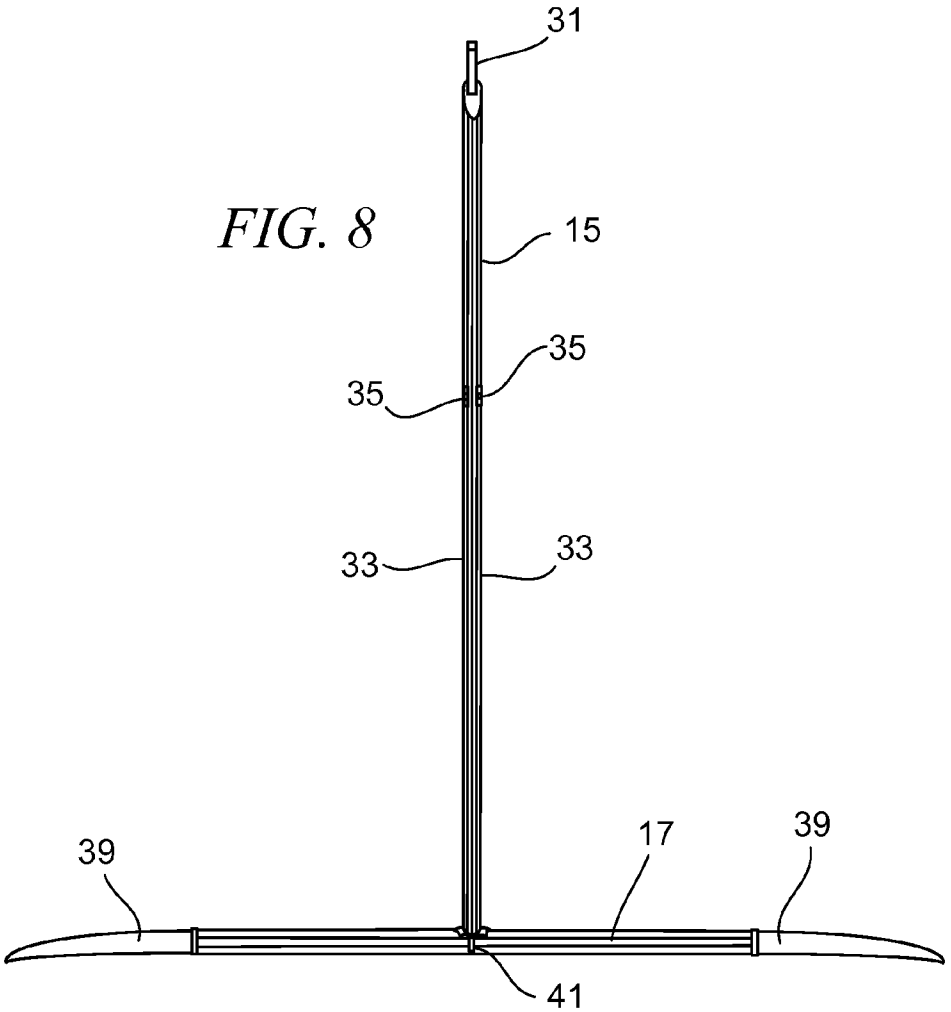
FIG. 8 is an end view of the main hydrofoil assembly in FIG. 3.
Figure 7:
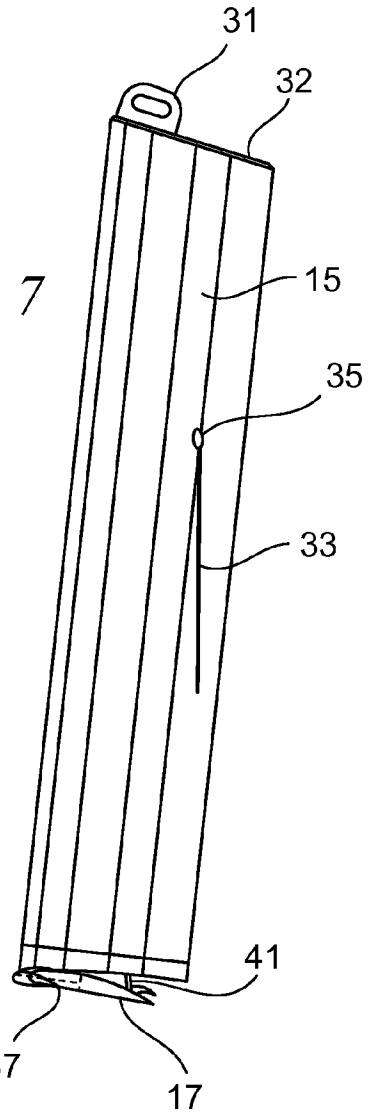
FIG. 7 is a side view of the main hydrofoil assembly in FIG. 3.
Figure 9:
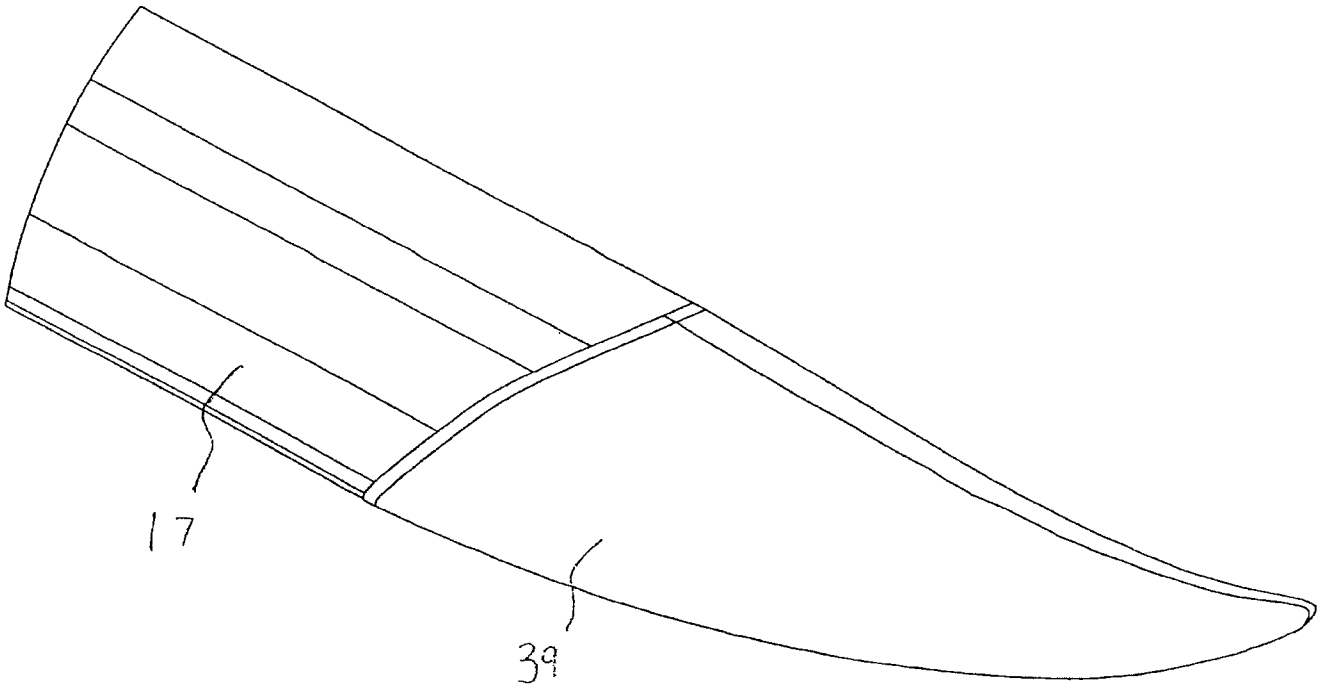
FIG. 9 is a close up view of an end of the hydrofoil in FIG. 3.

As illustrated in FIGS. 7 and 8, a pushrod 41 of the control mechanism can provide downward force to the hydrofoil 17, to increase or maintain the angle of attack of the hydrofoil. The incidence (angle of attack) of the hydrofoil, in conjunction with other factors such as speed of the hydrofoil relative to the water affects the lift generated. As the main hydrofoil 17 is coupled 37 to the vertical foil 15 with an axis near the centre of pressure of the hydrofoil, only minimal force is required by the pushrod to change the angle of attack of the hydrofoil during forward movement of the hydrofoil assembly 9 through water. In another embodiment, the axis may be slightly forward of the centre of pressure.

Figure 12:
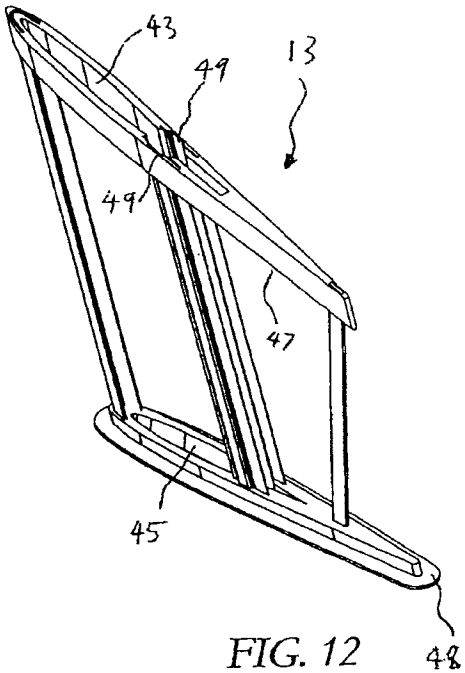
FIG. 12 is an alternative isometric view of the support in FIG. 10.
Figure 11:
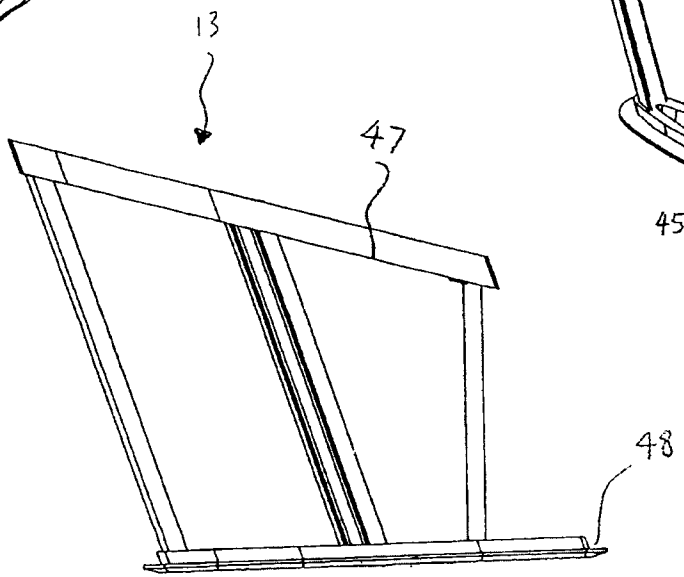
FIG. 11 is a side view of the support in FIG. 10.
Figure 10:
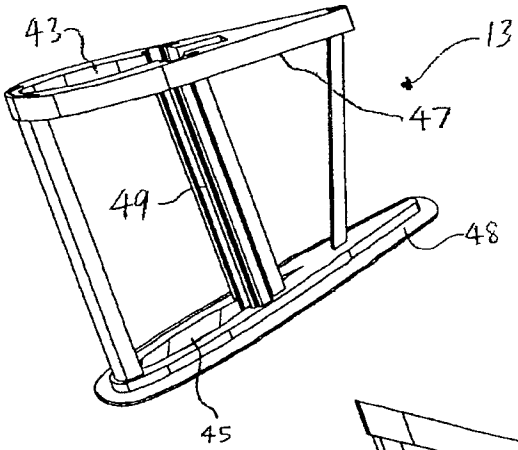
FIG. 10 is an isometric view of a support of the main hydrofoil assembly in FIG. 3.

FIGS. 10 to 12 illustrate a support 13 that is provided with an upper aperture 43, and a lower aperture 45 to slidingly receive the vertical foil 15. A retaining surface 47, is provided to abut with the support surface 32 of the vertical foil 15 in the extended configuration. A pair of channels 49 accommodates and retains the wands 33 of the vertical foil 15 when in the retracted configuration.

Figure 23:
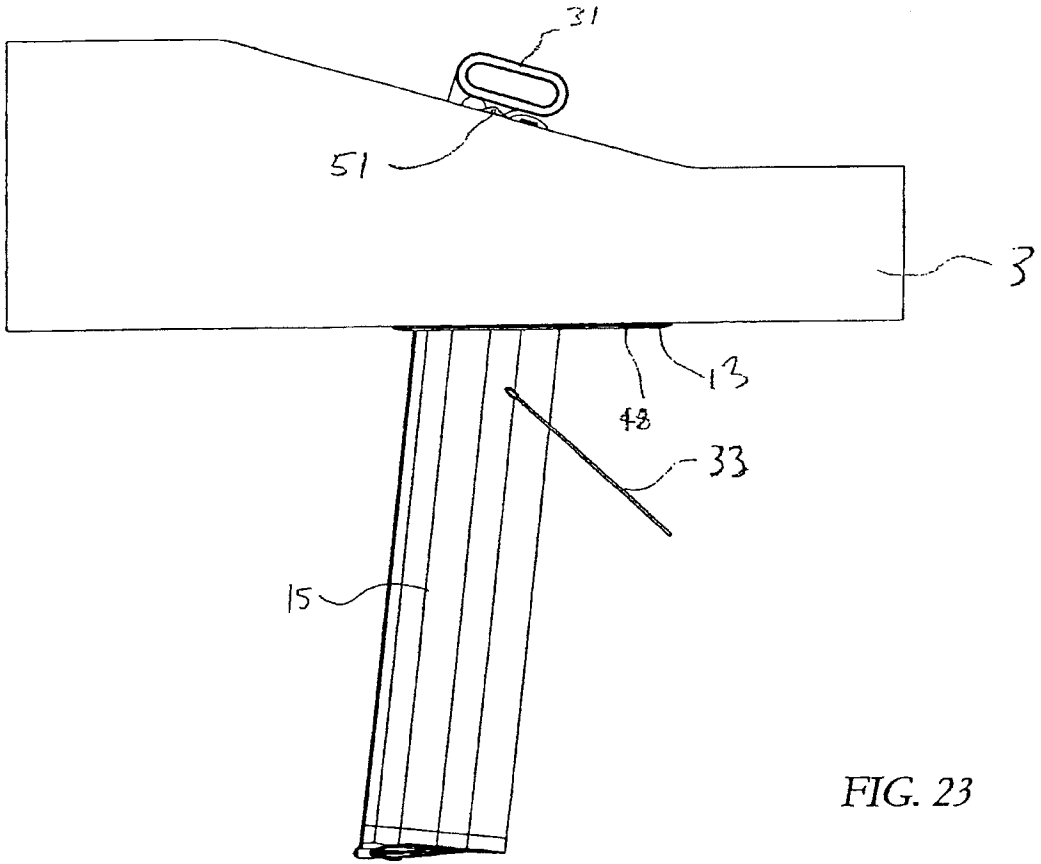
FIG. 23 is a side view of the main hydrofoil assembly in an extended configuration and locked with a shear pin.

A flange 48 is provided at the lower portion of the support 13, which in use is in abutment with the hull 3 to transfer upwardly directed forces to the hull 3, as illustrated in FIG. 23.

The sequence of changing the main hydrofoil assembly 9 from a retracted configuration to an extended configuration will now be described with reference to FIGS. 13 to 22.

Figure 14:
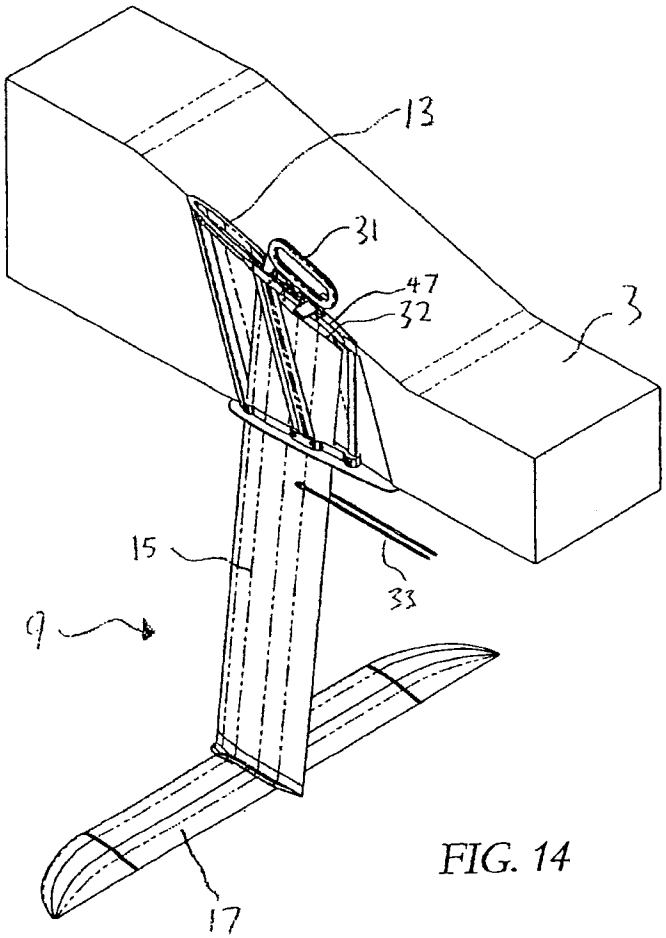
FIG. 14 is a rear isometric view of FIG. 13.
Figure 13:
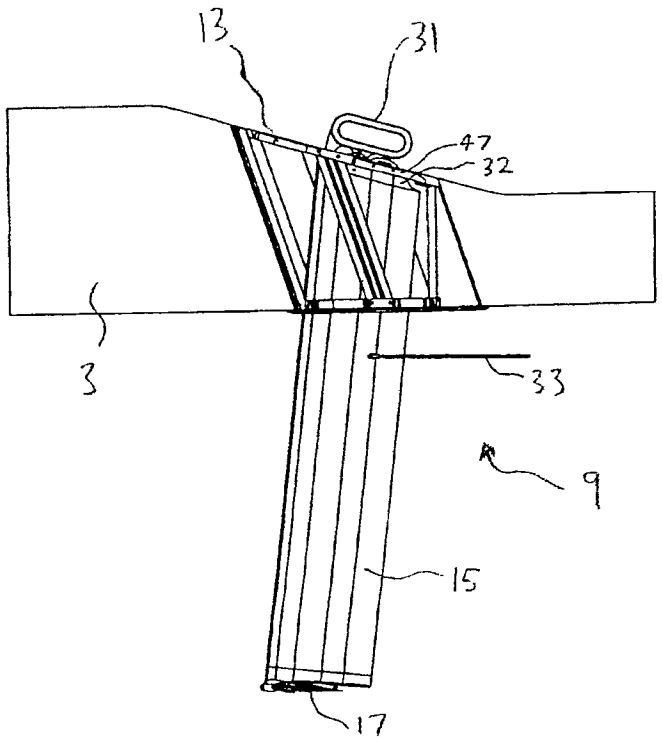
FIG. 13 is a side view of the main hydrofoil assembly in an extended and locked configuration.

FIGS. 13 and 14 illustrate the main hydrofoil assembly 9 in the extended and locked configuration. The support surface 32 of the vertical foil 15 abuts the retaining surface 47 to prevent the vertical foil 15 from moving vertically through the support 13.

Figure 16:
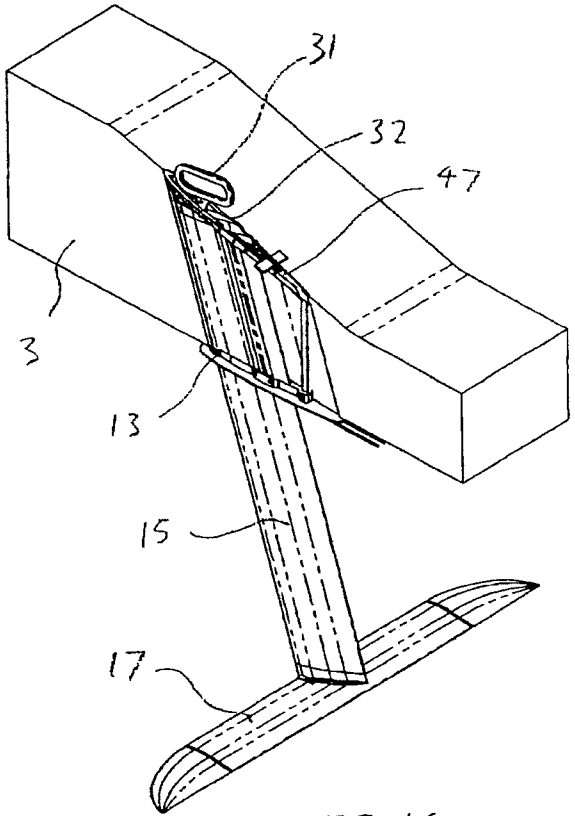
FIG. 16 is a rear isometric view of FIG. 15.
Figure 15:
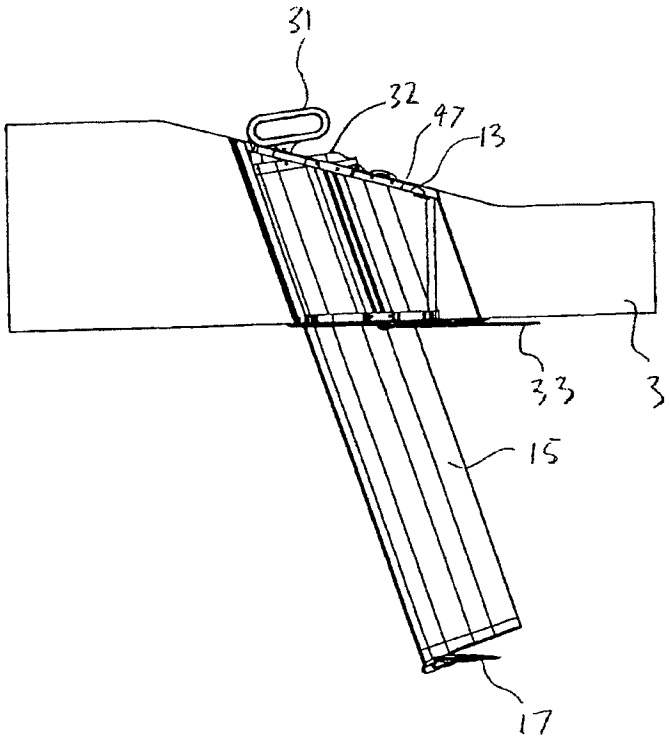
FIG. 15 is a side view of the main hydrofoil assembly in an extended and unlocked configuration.

FIGS. 15 and 16 illustrate the main hydrofoil assembly 9 extending from the support 13, but unlocked from the support 13. This is achieved by moving the handle 31 forward towards the bow of the vessel so that the support surface 32 is free from the retaining surface 47. The other end of the vertical foil 15 where the main hydrofoil 17 is attached correspondingly moves rearwards towards the stern of the vessel during this unlocking movement.

Figure 18:
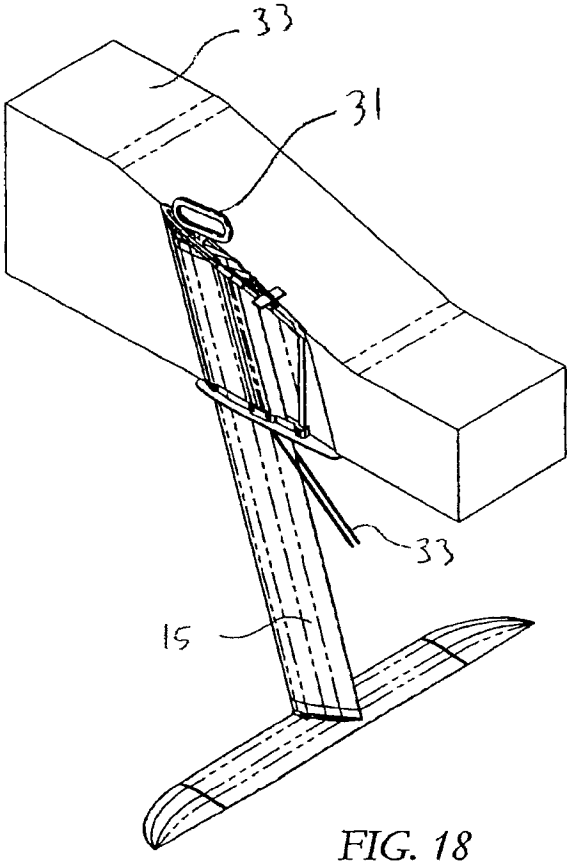
FIG. 18 is a rear isometric view of FIG. 17.
Figure 17:
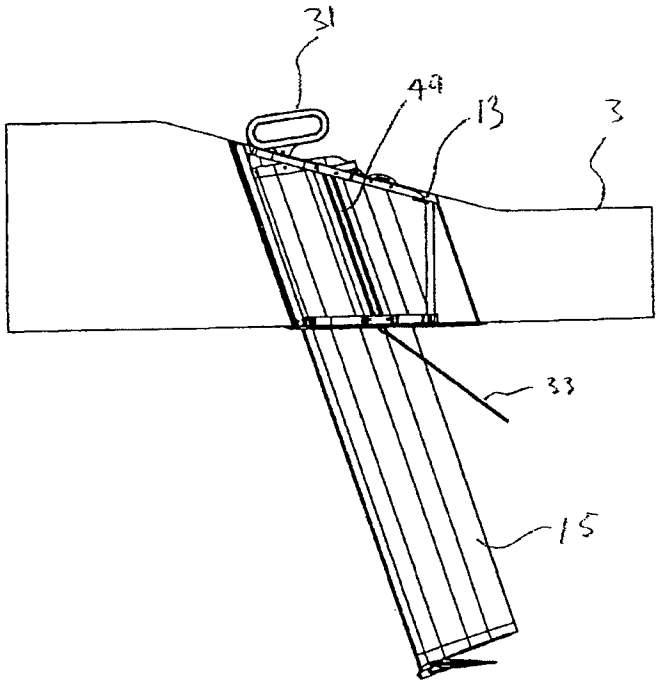
FIG. 17 is a side view of the main hydrofoil assembly with the vertical foil slightly retracted and the wand orientating to slide into a channel of the support.
Figure 20:
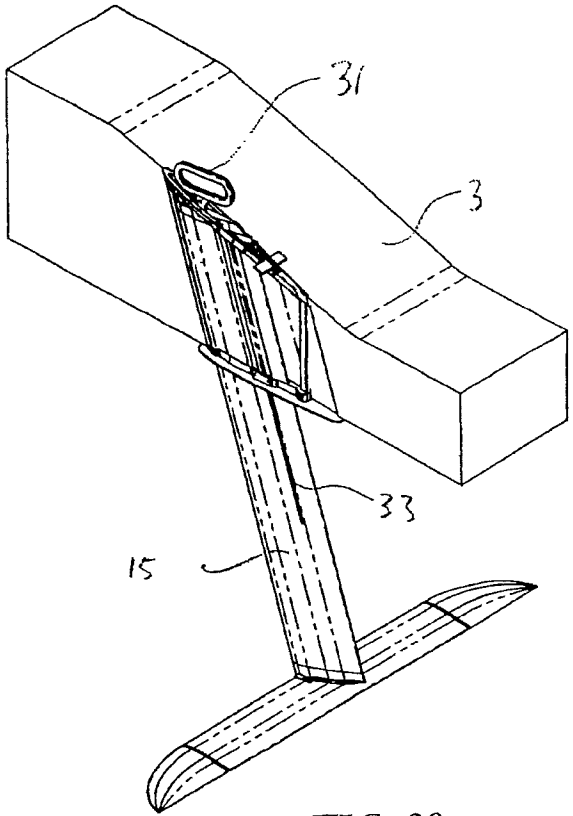
FIG. 20 is a rear isometric view of FIG. 19.
Figure 19:
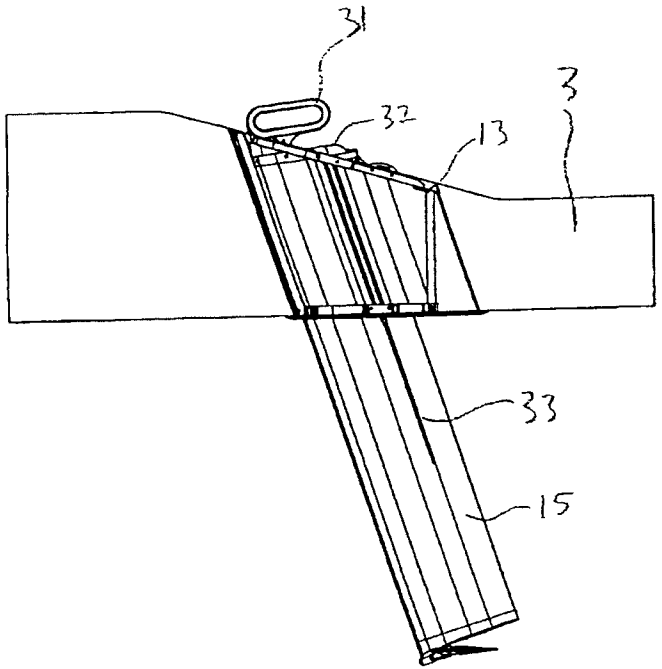
FIG. 19 is a side view of the main hydrofoil assembly with the vertical foil slightly retracted and the wand orientated to slide into the channel of the support.

FIGS. 17 and 18 illustrate the vertical foil 15 as it is retracted through the support 13, by pulling up on the handle 31. As the wand 33 is introduced into the channel 49, the channel 49 guides the wand 33 downwards so the length of the wand is parallel to the length of the channel. This is best illustrated in FIGS. 19 and 20, where the wand 33 is orientated with the channel 49 to allow the vertical foil 15 to be further retracted upwards into the support 3.

Figure 22:
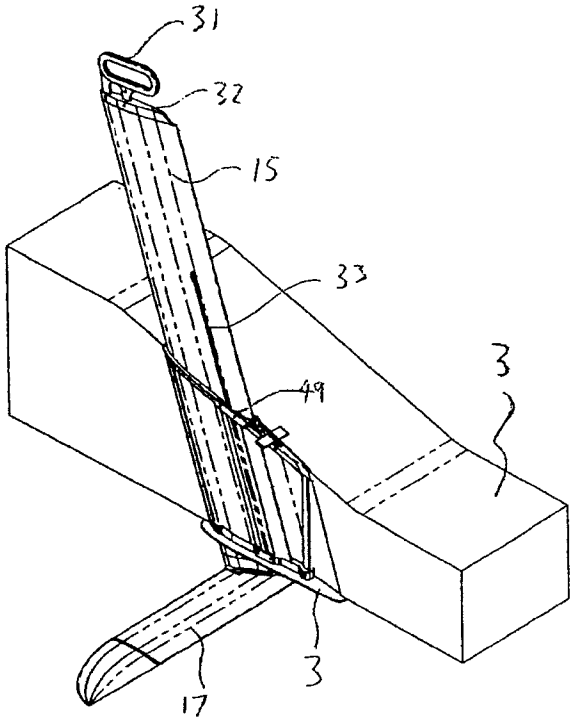
FIG. 22 is a rear isometric view of FIG. 21.
Figure 21:
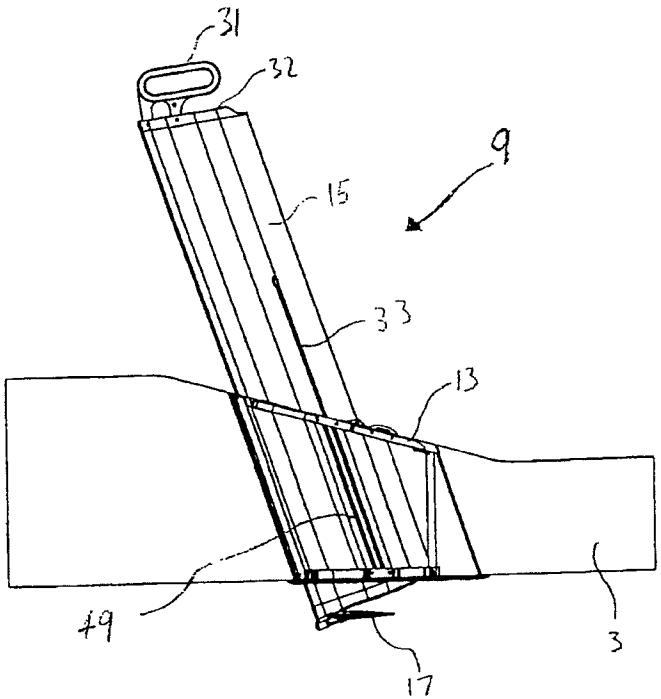
FIG. 21 is a side view of the main hydrofoil assembly in the retracted configuration.

In the fully retracted configuration, as illustrated in FIGS. 21 and 22, the vertical foil 15 is retracted with the main hydrofoil 17 in a proximal position to the hull 3. The wands 33 are substantially parallel with the vertical foil 15, with a portion of the wand 33 captured in the channel 49 of the support 3, thus preventing any pivotal movement of the wand 33. In the retracted configuration, the main hydrofoil 17 is allowed to freely rotate. As the hydrofoil 17 is symmetrical in foil section, the foil section would naturally bias to a neutral orientation (i.e. substantially zero angle of attack), when water flows past the freely pivoting hydrofoil 17. Alternatively, the main hydrofoil 17 may be locked with a substantially zero angle of attack. In either case, having the main hydrofoil 17 in a neutral orientation reduces drag of the hydrofoil 17 when in a retracted configuration.

Figure 24:
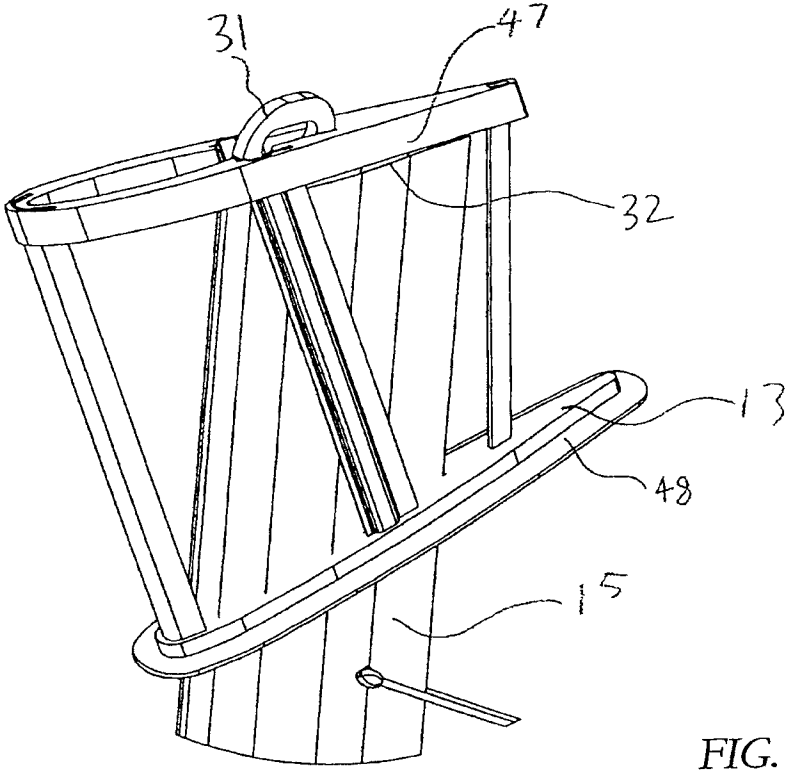
FIG. 24 is a close up isometric view of the vertical foil and the support 3 in the extended and locked configuration.

To change the main hydrofoil assembly 9 from the retracted configuration to the extended configuration, the steps above are reversed. Thus the vertical foil 15 is lowered to the extended configuration, and the handle 31 moved to a rearward position so that the support surface 32 and the retaining surface 47 abut to prevent retraction of the vertical foil 15, as illustrated in FIG. 24. To prevent the vertical foil 15 from moving out of the locked position, a pin 51 connected to the support 13 or hull 3, is passed through the handle 31 as illustrated in FIG. 23.

In one embodiment, the pin 51 is a shear pin designed to shear after a particular threshold of shear force is applied. If the hydrofoil assembly 9 is extended and locked, and the hydrofoil assembly 9 hits rocks or the bed of the body of water during forward motion, a rearward force at the lower end of the vertical foil 15 will be imparted. This force will be cantilevered at the support 13, such that the top of the vertical foil 15 near the handle 31 would be forced forward. If the force is sufficient, the pin 51 would shear, allowing the handle 31 to move forward so that hydrofoil assembly 9 is unlocked. This allows the vertical foil 15 to then retract through the support 13.

This safety feature allows the hydrofoil assembly 9 to automatically retract in the event of hitting the bed in shallow waters, thus preventing serious damage or capsizing of the vessel.

It is to be appreciated that other forms of locking the hydrofoil assembly 9 in the extended position may be used, such as a friction surface. The friction surface may be on the support surface 32 or the retaining surface 47, and may comprise of a serrated surface. The friction surface holds the vertical foil 15 in the extended and locked configuration by friction and is designed to release the vertical foil 15 from the locked configuration after a force is applied.

The operation of the control mechanism which determines variable lift of the main hydrofoil 9 will now be described with reference to FIGS. 25 to 33.

Figure 25:
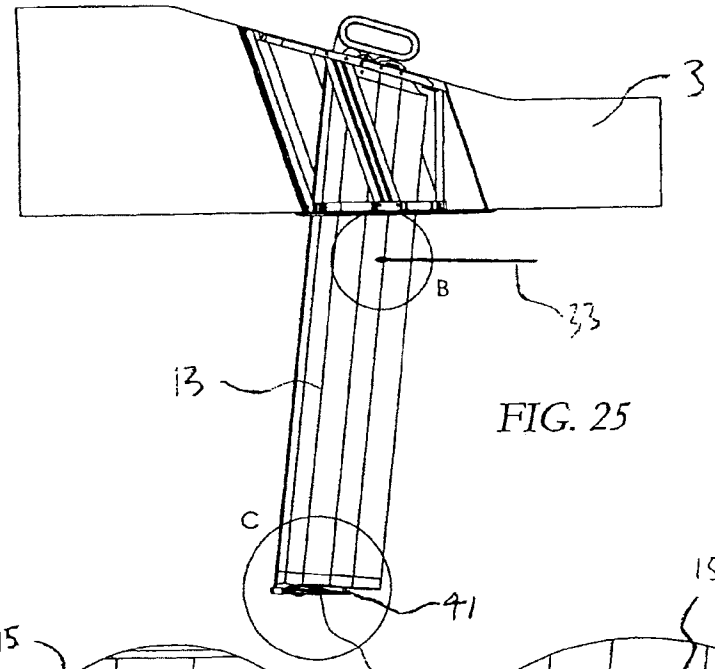
FIG. 25 is a side view of the main hydrofoil assembly when the altitude of the vessel is low.
Figure 27:
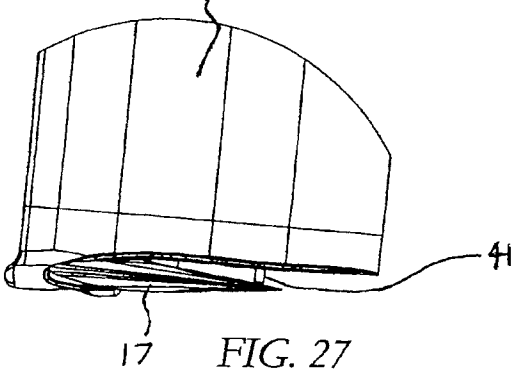
FIG. 27 is a close up of area C in FIG. 25.
Figure 26:
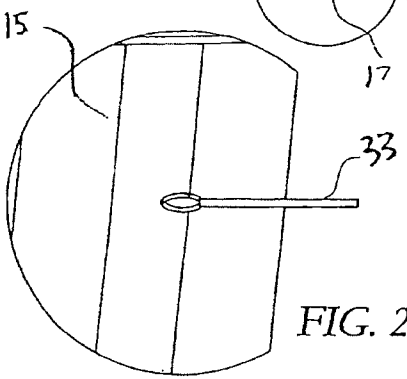
FIG. 26 is a close up of area B in FIG. 25.

When the altitude of the vessel 1 is in a low position, the flow of water pushes the wand 33 in a substantially horizontal position as illustrated in FIGS. 25 and 26. A cam 59 (see FIG. 47) is connected to the wand 33 and engages the top of the pushrod 41. When the wand is in the generally horizontal position, the cam 59 is in an orientation such that the pushrod is depressed as the cam 59 pushes downwards on pushrod 41. The pushrod 41 in turn pushes down on a trailing portion of the main hydrofoil 17, thereby pivoting the hydrofoil 17 to have a positive large angle of attack to create more lift, as illustrated in FIG. 27. This lift generated by the angle of attack of the foil in turn is designed to increase the altitude of the vessel 1.

Figure 28:
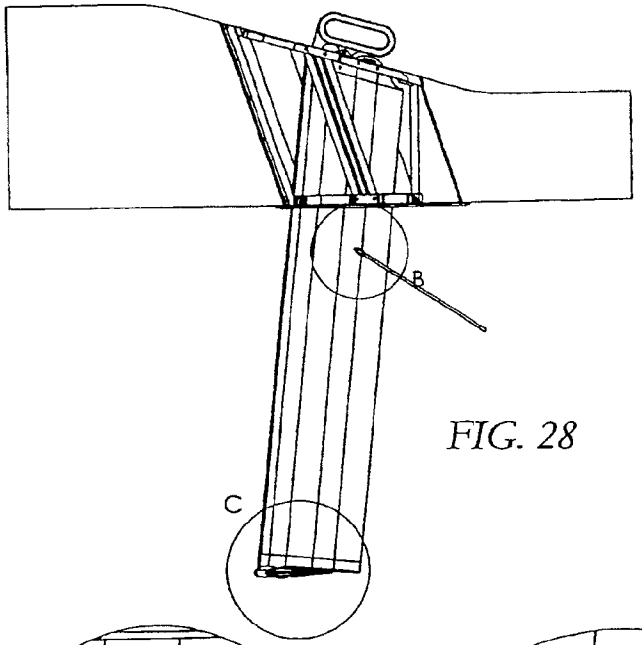
FIG. 28 is a side view of the main hydrofoil assembly when the vessel is at optimum altitude.
Figure 29:
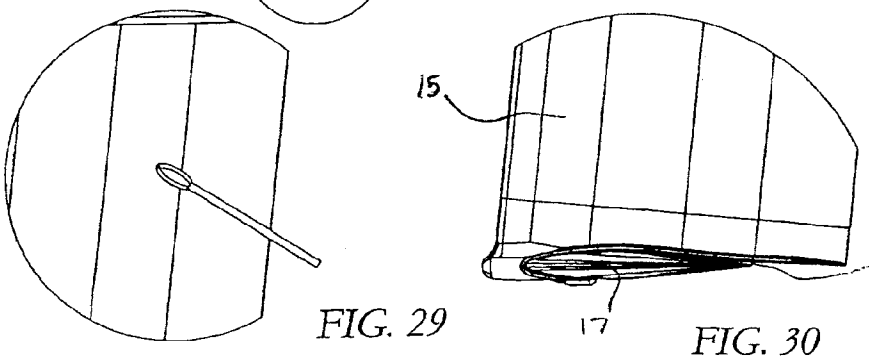
FIG. 29 is a close up of area B in FIG. 28.
Figure 30:
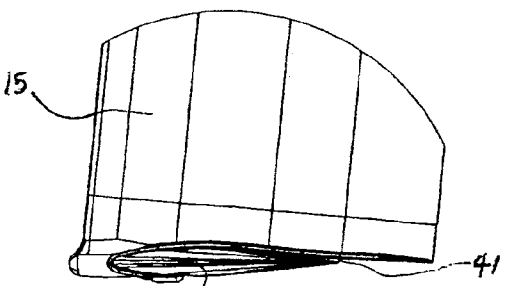
FIG. 30 is a close up of area C in FIG. 28.
Figure 47:
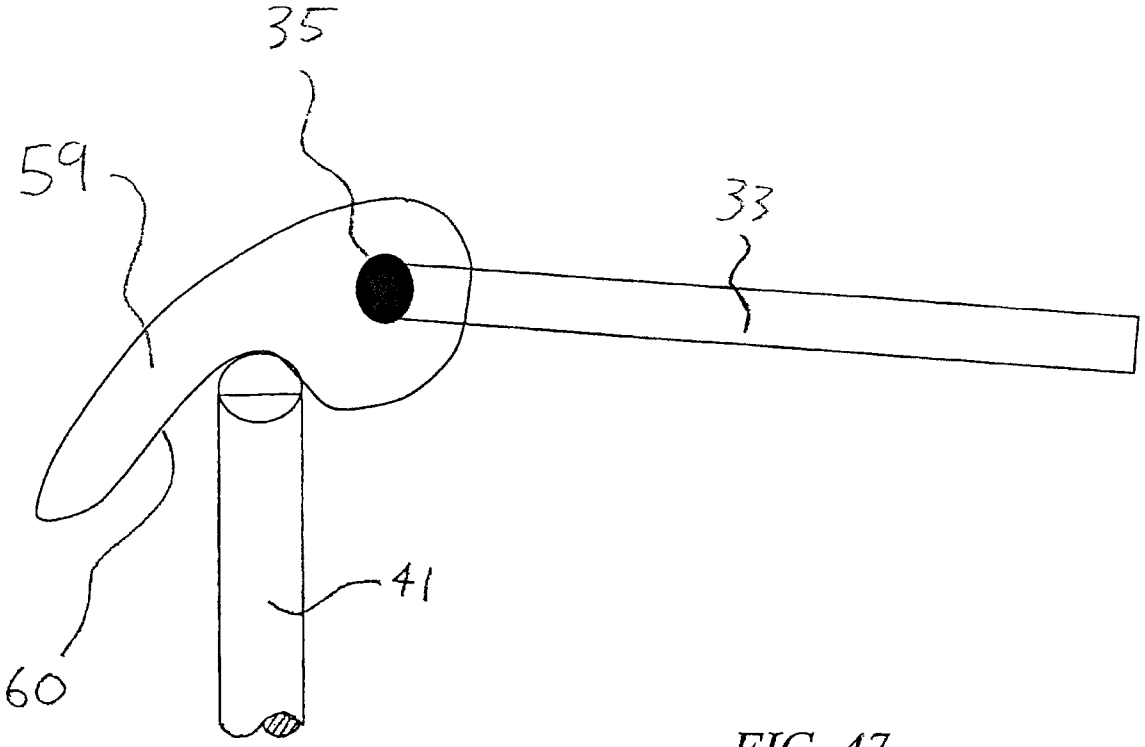
FIG. 47 is an isometric view of the control mechanism in the main hydrofoil assembly, illustrating the cam and pushrod.

As illustrated in FIGS. 28 and 29, when the altitude of the vessel 1 increases (i.e. the vessel lifts), the wand 33 continues to trail on the surface of the water and as such rotates from its horizontal position to an intermediate orientation between horizontal and vertical. This rotation of the wand causes rotation of the cam 59 which changes the amount the pushrod 41 is depressed by the cam. In particular the rotation of the cam (which is in a clockwise direction when arranged as shown in FIG. 47) allows the push rod to rise slightly (as it is forced upwardly by the hydrofoil). This reduces the angle of attack in the main hydrofoil 9 and thereby reduces the amount of lift on the vessel until an equilibrium is reached where the amount of lift generated by the hydrofoil is the same as that required to maintain the vessel at that altitude, As will be appreciated less lift and less angle of attack is required when the vessel is in the equilibrium position as shown in FIGS. 28 and 29 than when the altitude is in low position as described above and shown in FIGS. 25 and 26. The angle of attack of the main foil 17 to maintain the altitude of the vessel 1 is shown generally at FIG. 30.

Figures 31, 32, 33:
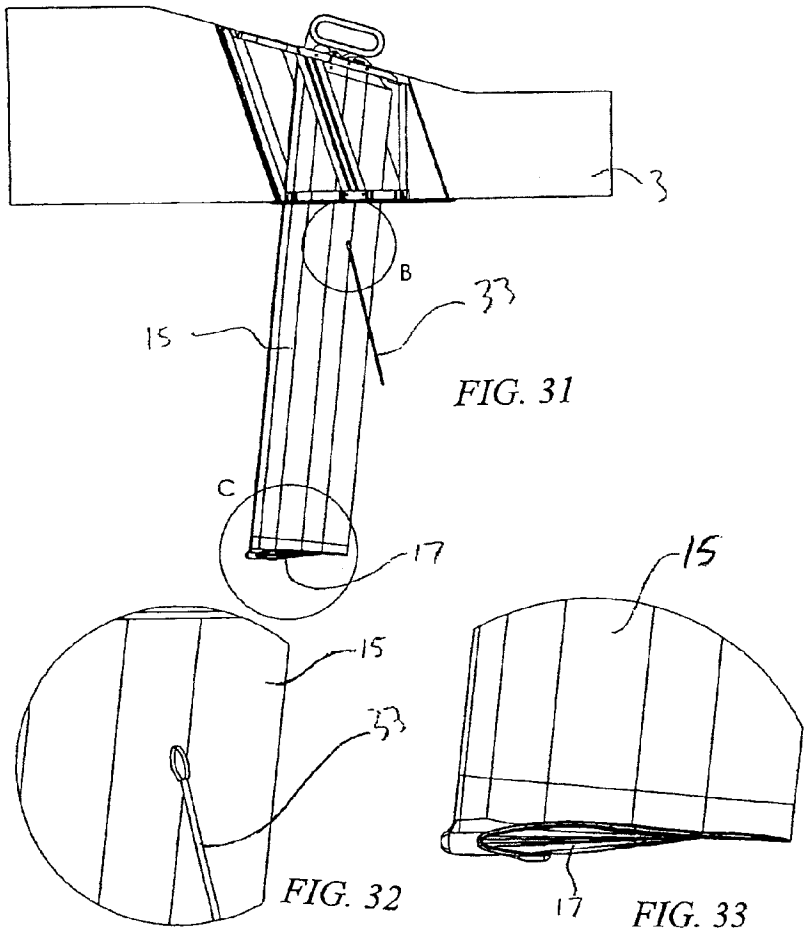
FIG. 31 is a side view of the main hydrofoil assembly when the altitude of the vessel is too high.
FIG. 32 is a close up of area B in FIG. 33.
FIG. 33 is a close up of area C in FIG. 33.

When the altitude of the vessel 1 is too high, the wand 33 drops to the surface of the water in a substantially downward orientation as illustrated in FIGS. 31 and 32. At this orientation, the cam 59 is further rotated in the clockwise direction which allows further rising of the pushrod 41 thereby allowing the main hydrofoil to reduce its angle of attack to the water flow, thus reducing lift which in turn causes the vessel 1 to lose altitude.

FIG. 47 illustrates an embodiment of the control mechanism inside vertical foil 15, comprising pushrod 41, cam 59 and pivot 35. The cam 59 is mechanically linked to the wands 33, and pivoting of the wands 33 pivots the cam 59 in unison. On rotation of the cam, such that the cam surface 60 moves towards the pushrod, the cam surface 60 pushes and moves pushrod 41 downwards. However, movement of the cam surface 60 away from the pushrod 41 is non-reciprocating, and thus upward movement of the cam surface 60, does not pull the pushrod 41 upwards. Instead, the flow of water over the main hydrofoil 17 biases the hydrofoil towards a neutral orientation, which causes the hydrofoil 17 to push upward on the pushrod 41.

The cam surface 60, provides non-linear actuation of the pushrod 41 relative to the orientation of the wands 33, thereby increasing or decreasing the change in displacement of the pushrod 41 at certain orientations of the wand. The amount and rate of change of displacement of the pushrod under rotation of cam is dependent of the profile of the contacting surface of the cam with the pushrod. As such the performance of the control mechanism can be "tuned" by varying this profile. In one embodiment, there is a decreasing change in the displacement of the pushrod as the orientation of the wand drops toward the surface of the water in a substantially downward orientation.

Figure 35:
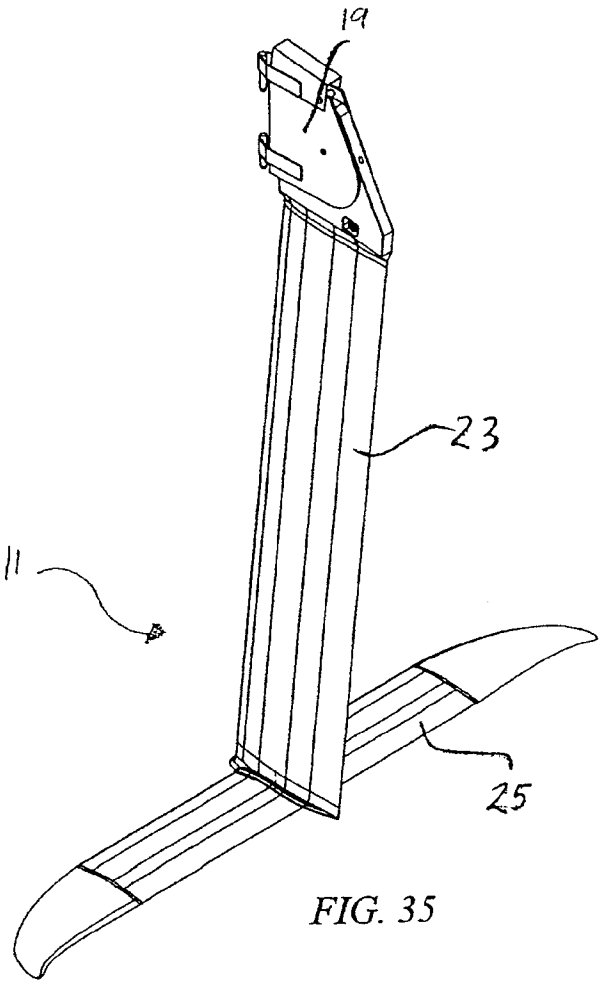
FIG. 35 is a rear isometric view of the assembly in FIG. 34.
Figure 34:
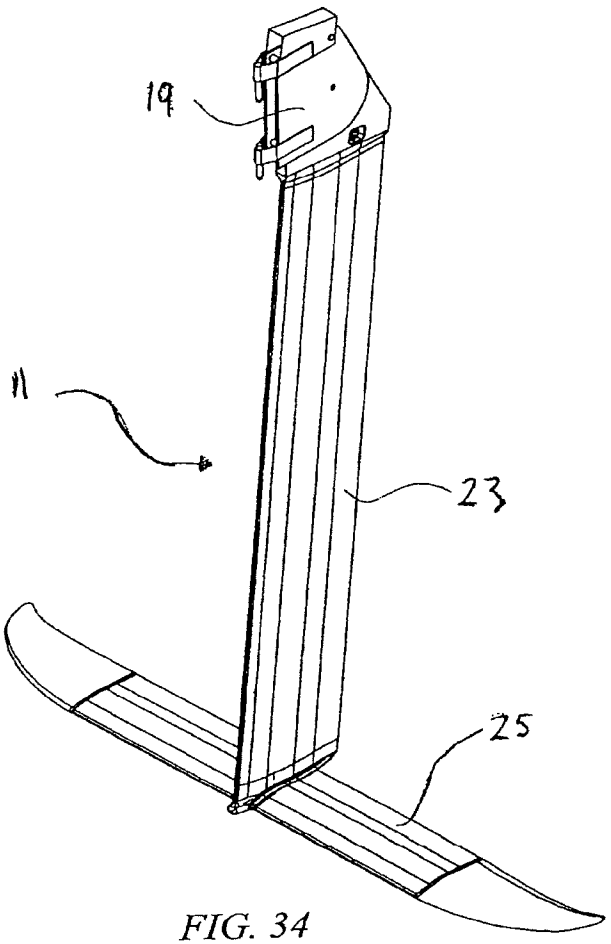
FIG. 34 is an isometric view of a rudder hydrofoil assembly in the extended configuration.

The structure of the rudder hydrofoil assembly 11 will now be described with reference to FIGS. 34 to 38. FIGS. 34 and 35 illustrate a rudder hydrofoil assembly 11 in the extended configuration. The rudder foil 23, is orientated and locked substantially downwards from the rudder support 19. The rudder hydrofoil 25, is pivoted and locked so that the angle of the rudder hydrofoil 25 relative to the rudder foil 23 is fixed. In one embodiment, the angle may be fixed to provide a fixed angle of attack for lift.

Figure 37:
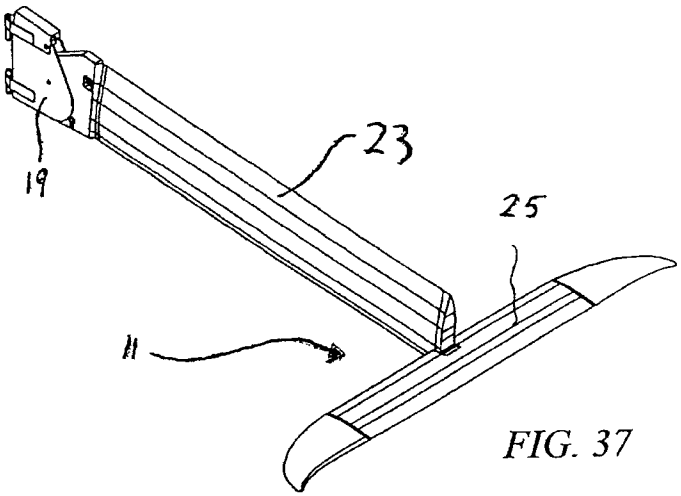
FIG. 37 is rear isometric view of the assembly in FIG. 36.
Figure 36:
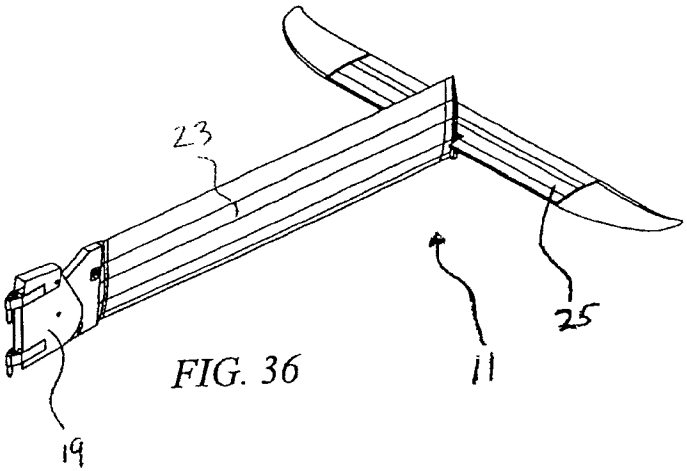
FIG. 36 is an isometric view of the rudder hydrofoil assembly in FIG. 34 in the retracted configuration.
Figure 38:
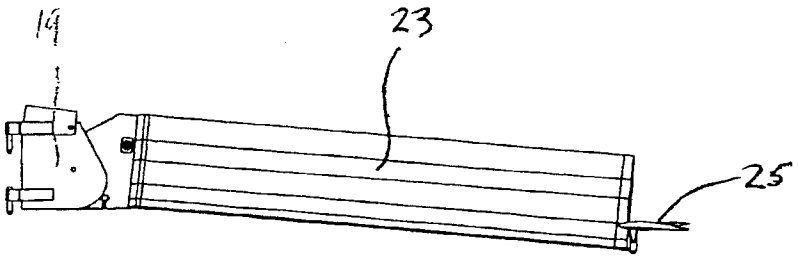
FIG. 38 is a side view of the assembly in FIG. 36.

FIGS. 36 to 38 illustrate a rudder hydrofoil assembly 11 in the retracted configuration. The rudder foil 23 is substantially orientated horizontally, and the rudder hydrofoil 25 is allowed to freely pivot. The flow of water over the rudder hydrofoil 25 will naturally bias the rudder hydrofoil 25 to a neutral orientation with a substantially zero angle of attack. Alternatively, the rudder hydrofoil 25 may be locked horizontally with a substantially zero angle of attack.

Figure 39:
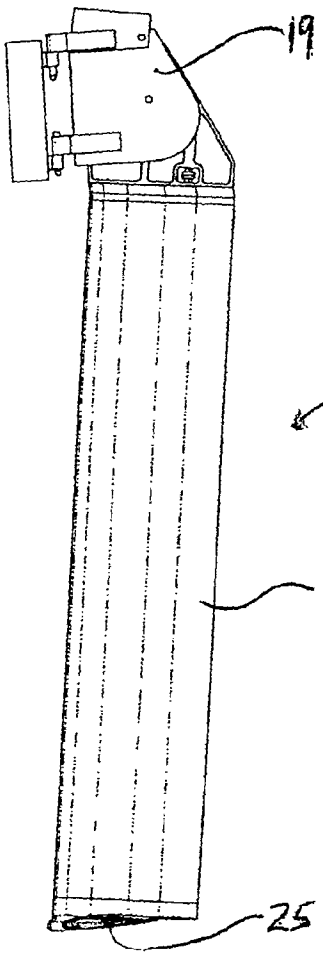
FIG. 39 is a side view of the rudder hydrofoil assembly in the extended configuration.
Figure 40:
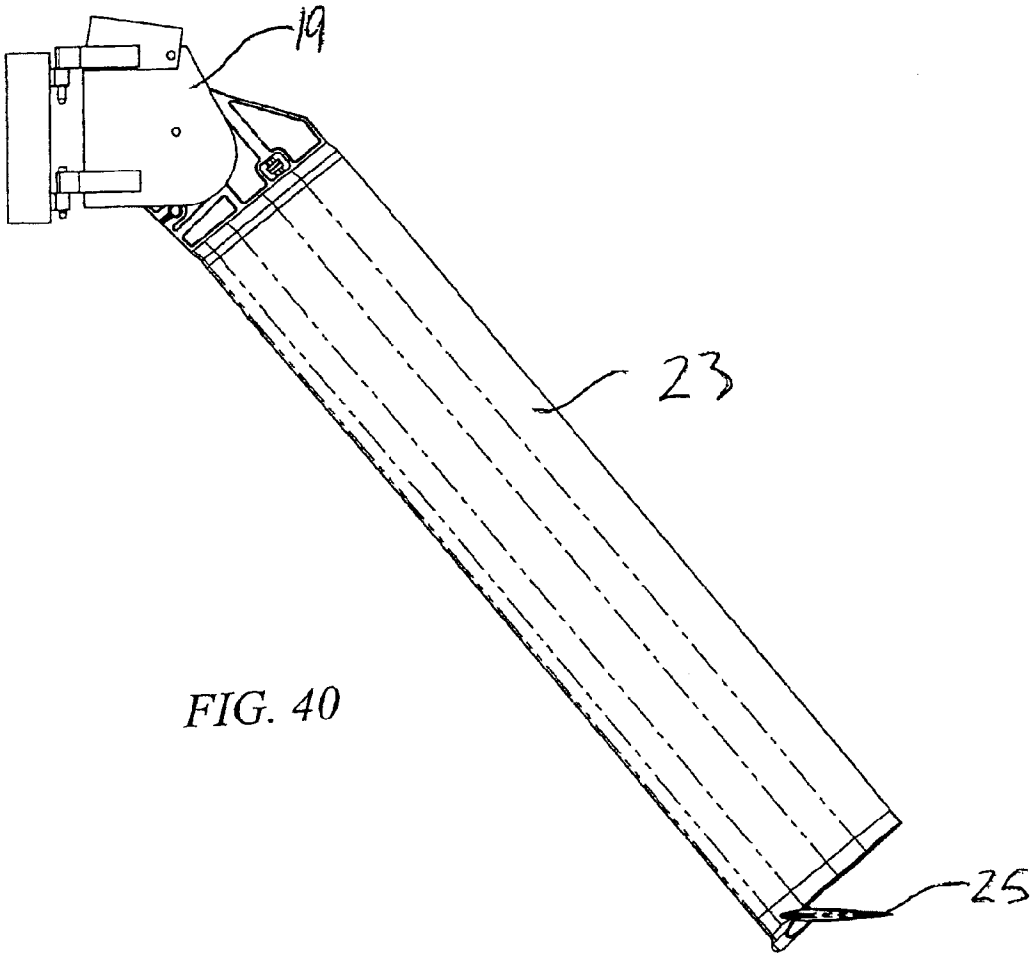
FIG. 40 is a side view of the assembly in FIG. 39 in a partially retracted configuration.
Figure 41:
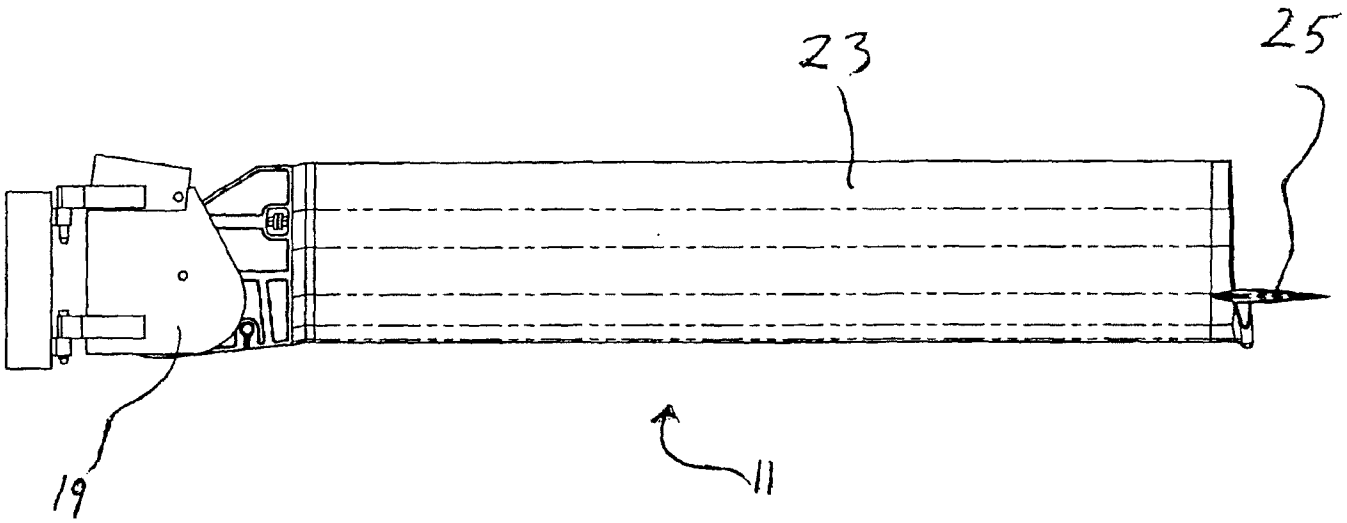
FIG. 41 is a side view of the assembly in FIG. 39 in a fully retracted configuration.

FIGS. 39 to 41 illustrate the sequence of the rudder hydrofoil assembly 11 retracted from the extended configuration. As illustrated in FIGS. 40 and 41, once the rudder hydrofoil assembly 11 is unlocked from the extended configuration, the rudder hydrofoil 25 is free to rotate to a neutral orientation. This ensure the rudder hydrofoil 25 does not create unnecessary drag, as would occur if the rudder hydrofoil 25 orientation was fixed relative to the rudder foil 23.

The main hydrofoil assembly 9 may form part of a centreboard assembly of a vessel 1. In another form, the main hydrofoil assembly 9 is mounted to a centreboard insert. The main hydrofoil assembly 9 may form part of a retrofit kit to replace a centreboard assembly of a vessel.

The rudder hydrofoil assembly 11 forms part of the rudder of the vessel, and may be mounted to the rudder box. The rudder hydrofoil assembly 11 may also form part of a retrofit kit to replace a rudder and rudder assembly of a vessel.

To simplify manufacture of the hydrofoil assemblies 9 and 11, it may be convenient to use common foil sections for the vertical foil, main hydrofoil, rudder foil and rudder hydrofoil. The foils may be manufactured by extrusion, and cut to length to suit respective foil and hydrofoil components of the hydrofoil assemblies.

An advantage of an embodiment of the hydrofoil assembly is it allows the hydrofoil to be easily retracted when launching or recovering the vessel, or to allow navigating in shallow waters.

Another advantage of an embodiment of the hydrofoil assembly is that the hydrofoil assembly can automatically retract if the hydrofoil hits the bed in shallow waters. This improves safety of the hydrofoil, and decreases the chance of damage to the vessel.

Another advantage of an embodiment of the hydrofoil assembly is that the control mechanism is integral to the hydrofoil assembly. This simplifies construction, manufacture and maintenance. Furthermore, the integral control mechanism does not require components that intrude or interfere in other areas of the vessel.

An advantage of an embodiment of the hydrofoil assembly is the natural biasing force of the hydrofoil to a neutral position. This reduces drag in the system, as well as the need for a reciprocating actuator in the control mechanism.

Another advantage of an embodiment of the hydrofoil assembly is that it can be retrofitted to existing vessels without substantial modifications to the vessel.

An alternative embodiment of the main hydrofoil assembly 109 will now be described with reference to FIGS. 42 and 43. The main hydrofoil assembly 109 comprises of a housing 161, a bay 163, a pivot arm 165, a vertical foil 115 and a main hydrofoil 17. The vertical foil 115 in this embodiment is pivotally attached to the housing 161 around pivot point 167.

Figure 42:
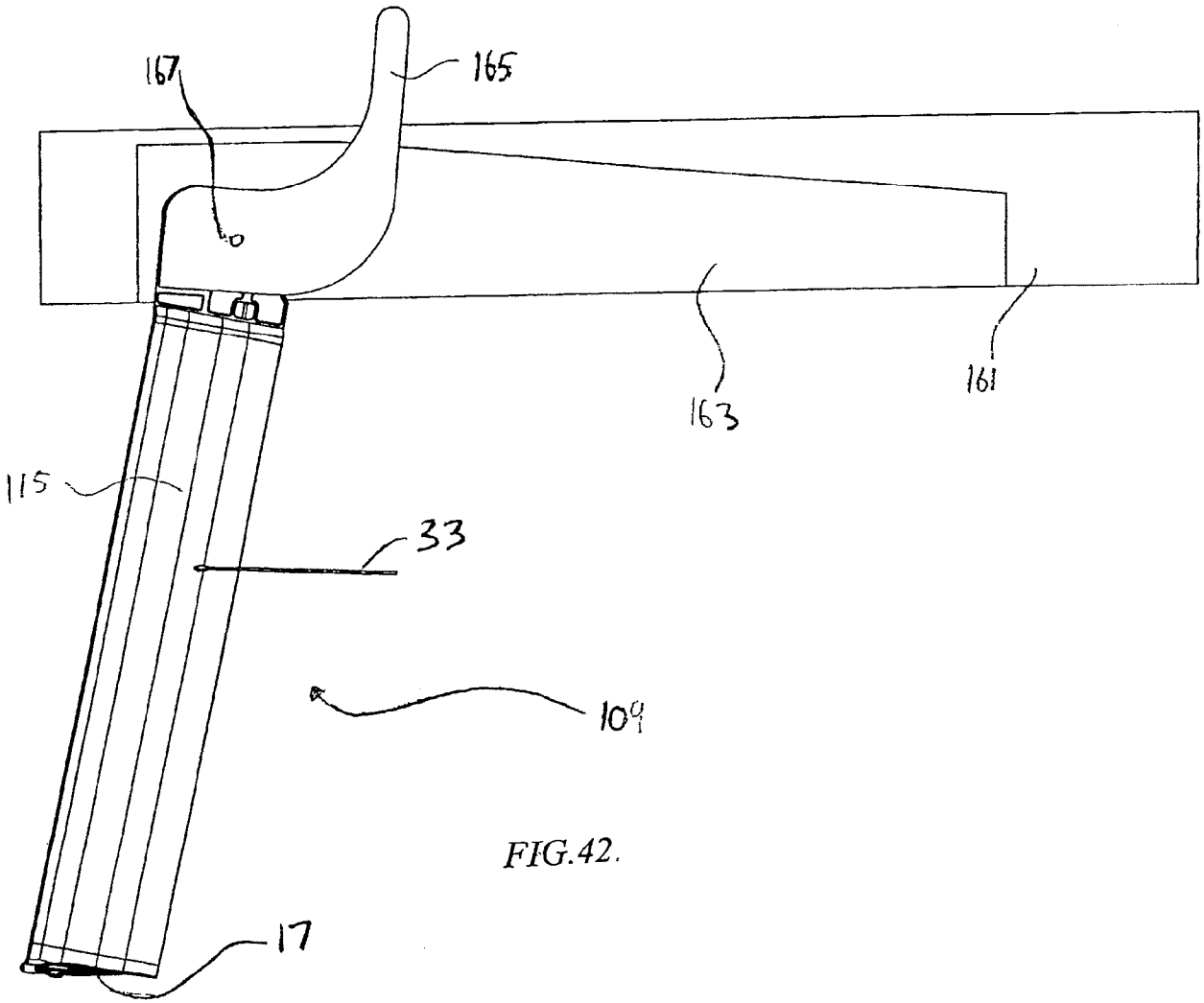
FIG. 42 is an alternative embodiment of a main hydrofoil assembly in the extended configuration.
Figure 43:
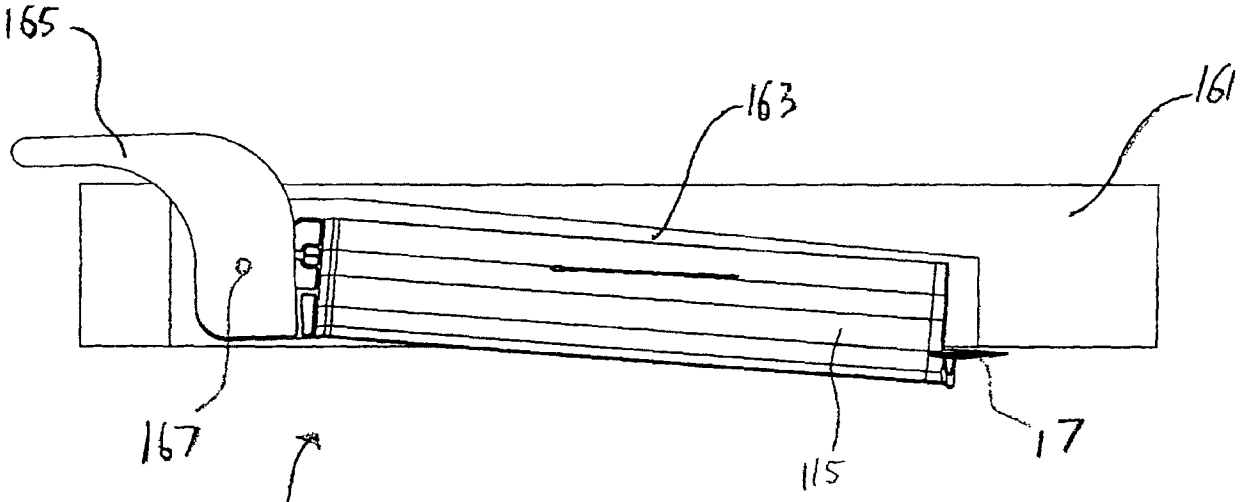
FIG. 43 is the assembly in FIG. 42 in a retracted configuration.

FIG. 42 illustrates the main hydrofoil assembly 109 in the extended configuration, wherein the pivot arm 165 is at a rearward position towards the stern. To retract the main hydrofoil assembly, the pivot arm 165 is moved to a forward position as illustrated in FIG. 43. When in the retracted configuration, the vertical foil 115 is recessed into the bay 163 of the housing 161, which reduces drag. As discussed above in the other embodiments, main hydrofoil 17 is free to pivot to a neutral orientation to reduce drag.

Figure 45:
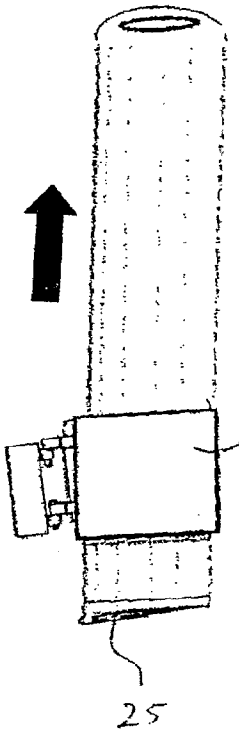
FIG. 45 is the assembly in FIG. 44 in the retracted configuration.
Figure 44:
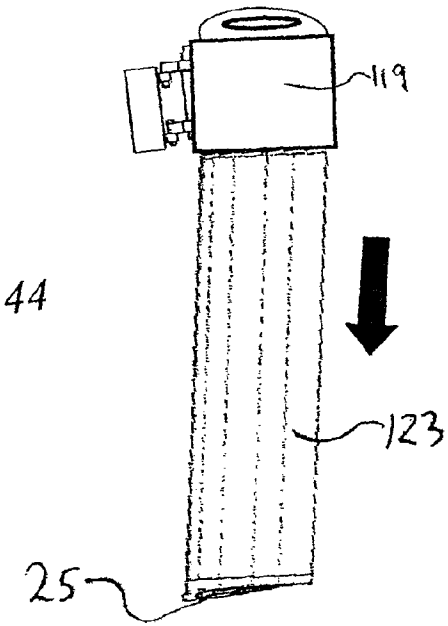
FIG. 44 is an alternative embodiment of a rudder hydrofoil assembly in the extended configuration.

An alternative embodiment of the rudder hydrofoil assembly 111 is illustrated in FIGS. 44 and 45. In this embodiment, the rudder foil 123 is vertically and slidingly retractable through the support 119.

Figure 46:
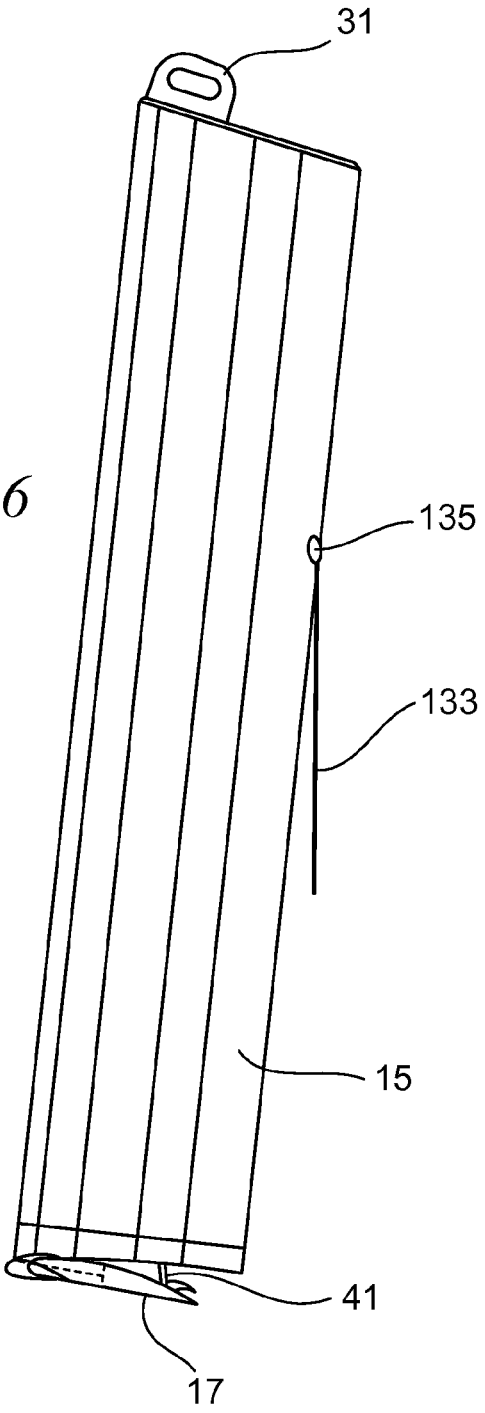
FIG. 46 is an alternative embodiment of the main hydrofoil assembly with the wand in an alternative location.

A further alternative is illustrated in FIG. 46. In this embodiment, a single wand 133 is mounted at the trailing rear of the vertical foil 15. As the wand is centred on the trailing edge, only one wand is required to provide the same response when the vessel 1 is heeled in either direction. In this embodiment, the corresponding support 13 may have a single channel to accommodate the wand 133 near the trailing edge of the vertical foil 15.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

What is claimed is:

1. A hydrofoil assembly for a waterborne vessel, comprising:

a body;

a hydrofoil mounted to the body, wherein the hydrofoil is adjustable to vary its lift characteristics; and a control mechanism operative to control the adjustment of the hydrofoil relative to the body, wherein the control mechanism comprises a sensor responsive to the altitude of the vessel relative to the water, a controller to provide a control output based on responses of the sensor, and an actuator to vary lift in the hydrofoil based on the control output of the controller, wherein the control output is nonlinear such that in use the amount the actuator moves in response to the sensor sensing a change in the vessel altitude is less when the vessel is in a lifted position as compared to when the vessel is in a lowered position.

2. A hydrofoil according to claim 1, wherein the controller has a contacting surface that contacts the actuator, and wherein the contacting surface is profiled and the control output is dependent on the position of the actuator on that contacting surface.

3. A hydrofoil assembly for a waterborne vessel, comprising:

a body;

a hydrofoil mounted to the body, wherein the hydrofoil is adjustable to vary its lift characteristics; and a control mechanism operative to control the adjustment of the hydrofoil assembly relative to the body, wherein the control mechanism comprises a sensor responsive to the altitude of the vessel relative to the water, a controller to provide a control output based on responses of the sensor, and an actuator to vary lift in the hydrofoil based on the control output of the controller, wherein the controller has a contacting surface that contacts the actuator, and wherein the contacting surface is profiled and the control output is dependent on the position of the actuator on that contacting surface.

4. A hydrofoil according to claim 3, wherein the controller provides a control output that is non-linear to the sensor responses.

5. A hydrofoil assembly according to claim 1, wherein the controller providing the non-linear control output is a mechanical cam connected to the actuator.

6. A hydrofoil according to claim 1, wherein at least part of the control mechanism is mounted to the body.

7. A hydrofoil according to claim 1, wherein at least part of the control mechanism is mounted within the body.

8. A hydrofoil assembly according to claim 1, wherein the sensor comprises a displaceable wand pivotally mounted to the body.

9. A hydrofoil assembly according to claim 1, wherein the hydrofoil is mounted to the body by a coupling, the hydrofoil being able to articulate about the coupling to provide a variable-incidence hydrofoil, and wherein the actuator is a push-rod connected to the hydrofoil to articulate the hydrofoil about the coupling.

10. A hydrofoil assembly according to claim 9, wherein the coupling has a pivot axis about which the hydrofoil articulates, the pivot axis extending through or proximal to the center of pressure of the hydrofoil.

11. A hydrofoil assembly according to claim 1, wherein the actuator provides a biasing force in only one direction and in the absence of biasing force by the actuator, the hydrofoil is configured so that it is biased in use to return to the neutral position by water flowing across the hydrofoil.

12. A hydrofoil assembly according to claim 1, further comprising a support mountable to the vessel and the body is mounted to the support and movable relative to the support between a first and second position.

13. A hydrofoil assembly according to claim 12, further comprising a hydrofoil mounted to the body by a coupling having a pivot axis about which the hydrofoil articulates relative to the body to provide a variable-incidence hydrofoil, and the pivot axis extends through or proximal to the center of pressure of the hydrofoil.

14. A hydrofoil assembly according to claim 12, wherein the body is movable between the first and second positions at least in part by sliding of the body relative to the support.

15. A hydrofoil assembly according to claim 12, wherein the body is movable between the first and second positions at least in part by rotating of the body relative to the support.

16. A hydrofoil assembly according to claim 12, wherein the body is in an extended position in the first position and a retracted position in the second position.

17. A hydrofoil assembly according to claim 12, wherein the support has a forward end which in use is towards the bow of the vessel and a rearward end which in use is towards the stern of the vessel; and wherein the body is arranged to be movable relative to the support from a locked to an unlocked condition by displacement of a distal end of the body toward the rearward end of the support.

18. A hydrofoil assembly for a waterborne vessel, comprising:

a body;

a hydrofoil pivotally attached to the body, wherein during forward motion of the vessel, water flowing across the hydrofoil biases the hydrofoil to pivot to a neutral position in which no lift is generated; and an actuator arranged to apply a biasing force to the hydrofoil to change the incidence of the hydrofoil relative to body to create lift, wherein the actuator provides a biasing force in only one direction and in the absence of biasing force by the actuator, the hydrofoil is configured so that it is biased in use to return to the neutral position by water flowing across the hydrofoil.

19. A hydrofoil assembly according to claim 18, wherein the hydrofoil has a symmetrical foil section.

20. A hydrofoil assembly according to claim 18, wherein the body is a foil and the body and hydrofoil have identical foil sections.

* * * * *

UNITED STATES PATENT AND TRADEMARK OFFICE

CERTIFICATE OF CORRECTION

PATENT NO. : 8,893,640 B2
APPLICATION NO. : 13/772032
DATED : November 25, 2014
INVENTOR(S) : William Peter Stephinson and Ian Alan Ward It is certified that error appears in the above-identified patent and that said Letters Patent is hereby corrected as shown below:

In the Claims

Col. 10, line 37, Claim 2, delete "A hydrofoil according to claim" and replace with -- A hydrofoil assembly according to claim --.

Col. 10, line 58, Claim 4, delete "A hydrofoil according to claim" and replace with -- A hydrofoil assembly according to claim --.

Col. 10, line 64, Claim 6, delete "A hydrofoil according to claim" and replace with -- A hydrofoil assembly according to claim --.

Col. 10, line 66, Claim 7, delete "A hydrofoil according to claim" and replace with -- A hydrofoil assembly according to claim --.

Signed and Sealed this
Twenty-first Day of April, 2015

Michelle K. Lee

Michelle K. Lee
*Director of the United States Patent and Trademark Office*